US009608342B2

(12) United States Patent
Tait

(10) Patent No.: US 9,608,342 B2
(45) Date of Patent: Mar. 28, 2017

(54) PLUG, SOCKET AND CONNECTION APPARATUS

(71) Applicant: Cameron Stuart Tait, Killarney (AU)

(72) Inventor: Cameron Stuart Tait, Killarney (AU)

( * ) Notice: Subject to any disclaimer, the term of this patent is extended or adjusted under 35 U.S.C. 154(b) by 0 days.

(21) Appl. No.: 14/790,339

(22) Filed: Jul. 2, 2015

(65) Prior Publication Data

US 2015/0303592 A1 Oct. 22, 2015

Related U.S. Application Data

(63) Continuation-in-part of application No. PCT/AU2014/000306, filed on Mar. 24, 2014.

(30) Foreign Application Priority Data

Mar. 28, 2013 (AU) ..... 2013901088
Sep. 19, 2014 (AU) ..... 2014903740

(51) Int. Cl.
*H01R 4/24* (2006.01)
*H01R 4/70* (2006.01)
*H01R 4/26* (2006.01)
*H01R 13/58* (2006.01)

(52) U.S. Cl.
CPC ..... *H01R 4/70* (2013.01); *H01R 4/26* (2013.01); *H01R 13/5816* (2013.01)

(58) Field of Classification Search
CPC ..... H01R 4/26
USPC ..... 439/391
See application file for complete search history.

(56) References Cited

U.S. PATENT DOCUMENTS 3,217,282 A 11/1965 Chevalier et al.
4,451,104 A * 5/1984 Hodgson ..... H01R 4/2412 439/391
4,508,409 A * 4/1985 Cherry ..... H01R 4/2491 174/84 R
4,612,423 A * 9/1986 Munroe ..... H01H 1/585 200/16 R
4,634,205 A * 1/1987 Gemra ..... H01R 4/2412 24/136 R
5,076,806 A 12/1991 Hotea et al.
5,306,195 A 4/1994 Hayashi
(Continued)

FOREIGN PATENT DOCUMENTS

EP 0653810 5/1995

OTHER PUBLICATIONS

Australian Patent Application No. 2015201133 Office Exam Report dated May 7, 2015.
(Continued)

*Primary Examiner* — Tho D Ta
(74) *Attorney, Agent, or Firm* — Perkins Coie LLP

(57) ABSTRACT

A plug (1), socket (30) and connection apparatus for making an electrical connection. The plug (1) can hold a wire (20) and be received within a socket (30) having a conductor (37) and sealant (39), for making a waterproof electrical connection. The plug (1) comprises a plug body (2) and a passage (7) extending axially within the plug body (2) for receiving a wire (20), wherein the plug body (2) is configurable in a first wire-receiving configuration so that a wire can be placed within the passage (7) and a second clamping configuration so that the plug body (2) can clamp to and retain the wire (20) within the passage (7) when received within the socket (30).

16 Claims, 24 Drawing Sheets

(56) References Cited

U.S. PATENT DOCUMENTS

| | | | | |
|---|---|---|---|---|
| 5,681,179 | A | 10/1997 | Lane | |
| 6,168,455 | B1 | 1/2001 | Hussaini | |
| 7,211,725 | B1 | 5/2007 | Tait | |
| 7,425,153 | B1 | 9/2008 | Miller | |
| 7,922,516 | B2 * | 4/2011 | Temblador ..... | H01R 4/2408 439/391 |
| 2004/0072461 | A1 | 4/2004 | Matsuda et al. | |

OTHER PUBLICATIONS

Australian Patent Application No. 2013901088 Office Exam Report dated Oct. 4, 2013.
PCT/AU2014/000306 International Search Report dated Jun. 26, 2014.
PCT/AU2014/000306 International Preliminary Report on Patentability dated Feb. 4, 2015.
European Search Report and Written Opinion dated Jul. 21, 2016 for European Application No. 14775475.8.

* cited by examiner

PLUG, SOCKET AND CONNECTION APPARATUS

This application is a continuation in part of International Patent Application No. PCT/AU2014/000306 filed 24 Mar. 2014 which designates the United States of America and claims priority of Australian Provisional Application No. 2013901088 filed 28 Mar. 2013; priority is also claimed to Australian Provisional Application No. 2014903740 filed 19 Sep. 2014. The entire contents of each of the foregoing are incorporated herein by cross-reference.

TECHNICAL FIELD

The present invention generally relates, inter alia, to a plug, a socket and to a connection apparatus. In a preferred embodiment, the connection apparatus can be used to make a waterproof electrical connection between a wire clamped by the plug and a conductor of the socket.

BACKGROUND ART

It will be clearly understood that, if a prior art publication is referred to herein, this reference does not constitute an admission that the publication forms part of the common general knowledge in the art in Australia or in any other country.

Electrical connectors for connecting one conductor to another are known. One such connector is described in the present applicant's earlier patent, U.S. Pat. No. 7,211,725. However, a problem with that connector is that there are some applications where it is difficult to insert the conductors into the patented connector, particularly when flexible cables are to be inserted to make the electrical connection. It can also be difficult to insert the cable in cramped situations or locations having access limited by configuration of the location, presence and/or orientation of other equipment and such like, or where the size of the cable is too small to afford sufficient pushing force into the connector.

Most commercially available electrical connectors are not suited to making electrical connections in moist or wet environments. In marine applications, in particular, direct contact of an electrical connection with, or even immersion in, water can occur, requiring the electrical conductors to be adequately insulated. Even if the electrical connection is kept away from direct contact with water, a hygroscopic plaque can build up on the surface, the plaque often being highly conductive due to its electrolyte content. It is therefore necessary to ensure electrical conductors are kept insulated electrically and separated physically from the environment whilst at the same time making a reliable electrical connection to an appliance or another conductor.

Although the connector of U.S. Pat. No. 7,211,725 provides a satisfactory solution to the problems associated with electrical connections in moist environments in many situations, it still suffers from the problem described above.

Another problem with the connector of U.S. Pat. No. 7,211,725 is that, because it is generally used to connect two wires together, it cannot be used to capture and incorporate an end of a wire into a type of plug that can then be plugged into a socket of an electrical appliance so as to make an electrical connection.

SUMMARY OF INVENTION

It is an object of the invention to provide a plug, socket or connection apparatus that minimises or overcomes a problem addressed above. An alternative object is to provide a plug, socket or connection apparatus for electrical use or other than for electrical use. An alternative object is to provide the public with a useful or commercial choice.

In a first aspect, the invention concerns: a plug for holding a wire and for being received within a socket (or a plug adapted to hold a wire and to be received within a socket), said plug comprising: a plug body and a passage extending axially within the plug body for receiving a wire, wherein the plug body is configurable in a first wire-receiving configuration so that a wire can be placed within the passage and a second clamping configuration so that the plug body can clamp to and retain the wire within the passage.

In a second aspect, the invention concerns a plug for holding a wire (or a plug adapted to hold a wire), said plug comprising: a plug body comprising: an inside face and an outside face; a passage extending axially within the plug body for receiving a wire; and at least one gripping formation extending inwardly from the inside face for gripping a wire when located within the passage, wherein the plug body is configurable in a first wire-receiving configuration so that a wire can be placed within the passage and a second clamping configuration so that the plug body can clamp to and retain the wire within the passage when the plug has been received within a socket.

In a third aspect, the invention concerns a plug assembly comprising the plug as defined according to the first aspect or second aspect and a wire.

In a fourth aspect, the invention concerns a socket for receiving the plug as defined according to the first aspect or second aspect, or the plug assembly according to the third aspect.

In a fifth aspect, the invention concerns a connection apparatus comprising: the plug as defined according to the first aspect or second aspect, or the plug assembly as defined according to the third aspect; and/or the socket as defined according to the fourth aspect.

In a sixth aspect, the invention concerns a method of forming a connection and optionally an electrical connection comprising the steps of: locating a wire within a plug as defined according to the first or second aspect; and receiving the plug within a socket according to the fourth aspect that optionally comprises an electrical conductor.

The plug can be of any suitable size, shape and construction, and can be made of any suitable material or materials. The plug can comprise a single component or more than one component. In some embodiments, the plug can comprise a plug body that directly engages a socket. In other embodiments, the plug can further comprise a plug adapter that connects to, engages with or receives the plug body and then enables the plug body to be snugly received by a socket. The plug adapter can carry out a number of different functions, including providing a sealing function so as to protect or fluid-proof/waterproof the wire or electrical connection, and/or modifying the overall size of the plug should the plug body be of inadequate size so as to be snugly received within a socket.

Any suitable type of wire can be held by the plug. The wire can be rigid or flexible. The wire can comprise rigid or malleable conducting filaments or strands and optionally an insulating exterior coating or sheath made of plastics material or rubber, for example. The wire can be in the form of a cable having interwoven conducting strands and a sheathed/coated exterior. The wire can be in the form of a coaxial cable having conducting filaments concentrically spaced and insulated from one another.

The plug body can be of any suitable size, shape and construction and can be made of any suitable material or materials. In a preferred embodiment the plug body is made of a non-conductive material or materials, such as plastics material, ceramics material, carbon fibre or rubber.

In an embodiment, the plug body can be of unitary construction and can be manipulated to adopt the second clamping configuration. This may be possible, for example, by way of two plug body portions being hinged together and moveable together via a live hinge into the second clamping configuration. The hinge can hinge the plug body portions such that the plug body portions pivot along an axis parallel with the passage or transversely of the passage. Alternatively, this may be possible, for example, by way of three, four or possibly more plug body portions being hinged together and moveable together into the second clamping configuration. The hinge or hinges can hinge the plug body portions such that the plug body portions pivot along an axis parallel to the passage or transversely of the passage.

The plug body can have a first end and a second end that is opposite the first end. The plug body can have socket receiving end or a plug adapter receiving end. In some embodiments, only one end of the plug body is received within a socket or plug adapter. In some other embodiments, both ends of the plug body are received within a socket or plug adapter.

In an embodiment, the plug body comprises two substantially identical body portions hinged together at an end of the plug body using at least one hinge, which hinge could be in the form of one or more fold lines. The substantially identical body portions can be like a sleeve or tube split into longitudinal halves and hinged at one end, or a sleeve or tube substantially sealed or semi-sealed at one end (end wall of the plug body) and split into longitudinal halves and hinged at one end.

In some embodiments, if received directly by a socket, the plug body can comprise two substantially identical body portions hinged together at a socket receiving end of the plug body (or optionally at the other end of the plug body), using at least one hinge, which hinge could be in the form of one or more fold lines. The substantially identical body portions can be like a sleeve or tube split into longitudinal halves and hinged at the socket receiving end (or optionally at the other end of the body), or a sleeve or tube substantially sealed or semi-sealed at one end (end wall of the plug body) and split into longitudinal halves and hinged at one end.

In other embodiments, if first received within a plug adapter, the plug body can comprise two substantially identical body portions hinged together at an end of the plug body that is not received within the plug adapter, using at least one hinge, which hinge could be in the form of one or more fold lines. The substantially identical body portions can be like a sleeve or tube split into longitudinal halves and hinged at an end, or a sleeve or tube substantially sealed or semi-sealed at one end (end wall of the plug body) and split into longitudinal halves and hinged at one end.

In another embodiment, the plug body can comprise two or more separate plug body pieces that can be connected together to adopt the second clamping configuration. For example, the plug body can comprise two substantially identical body pieces that can be connected together and possibly held together using male and female locking formations. For example, the plug body can comprise three or more body pieces that can be connected together and possibly held together using male and female locking formations.

In yet another embodiment, the plug can comprise at least one fastener, and the plug body can comprise two or more separate plug body pieces that can be connected together to adopt the second clamping configuration using the at least one fastener. The fastener can be, for example, a clip, clamp, band, screw, nail and/or adhesive. The fastener can be used in conjunction with male and female locking formations, if required.

The plug body can be in the form of a sleeve or tube extending around the wire when in the second clamping configuration and the sleeve or tube can be of any suitable cross-section. For example, the sleeve or tube can be of circular cross-section or of substantially circular cross-section when in the second clamping configuration. Alternatively, the sleeve or tube can be of triangular, rectangular or other geometrical cross-section when in the second clamping configuration. The inside and outside faces of the plug body can be of similar or differing cross-sections.

In some embodiments, the plug body end opposite the socket receiving end can be enlarged. For example, in one embodiment, the enlarged end can be in the form of a circumferentially extending flange. The flange may be gripped with fingers or using a pair of pliers when the plug body is in a second clamping configuration. The flange can abut the socket when the plug body has been received within the socket. The flange can sealingly engage the socket.

For example, in another embodiment, the enlarged end can be sized and shaped so as to be easily gripped with fingers or a pair of pliers when the plug body is in a second clamping configuration. The enlarged end (or head) can be of any suitable size and shape. In some embodiments, the enlarged end or head is cuboid in shape, in the shape of a cylinder, or in the shape of a rectangular prism, for example.

In some embodiments, the plug body end opposite a plug adapter receiving end can be enlarged. For example, in one embodiment, the enlarged end can be in the form of a circumferentially extending flange. The flange may be gripped with fingers or using a pair of pliers when the plug body is in a second clamping configuration. The flange can abut the plug adapter when the plug body has been received within the socket. The flange can sealingly engage the plug adapter.

The passage extending axially within the plug body for receiving a wire can extend completely through a central region of the plug body or partway along the plug body. Preferably, the passage extends centrally along a longitudinal axis of the plug body, completely through the plug body, including the ends/end wall/enlarged end/head of the plug body. Alternatively, one end of the passage, such as at the socket receiving end, could be blind or substantially blind, so as to completely or almost completely insulate/isolate an end of the wire—depending on the intended use (ie. non-electrical connection).

The passage can snugly receive the wire. The diameter of the passage and inside face of the plug body can vary depending on the gauge of the wire. The part of the passage extending through the enlarged end or head can be used to check wires for appropriate gauge size/diameter.

The at least one gripping formation can be of any suitable size, shape and construction. The at least one gripping formation can comprise one or more gripping teeth extending along the inside face of the plug body. Preferably the at least one gripping formation comprises one or more gripping teeth that are pointed in a direction that prevents or minimises the risk of the wire being pulled out of the passage in an axial direction. The wire can be snugly or tightly received by the gripping formation.

Preferably the gripping teeth extend around the inside face and are spaced along the longitudinal axis. Preferably the teeth are pointed perpendicularly towards the central longitudinal axis, or toward the socket receiving end, or toward the other end of the plug body, or away from the plug adapter receiving end.

The tooth or teeth of the at least one gripping formation may or may not deflect when gripping or biting into the wire. That is, the tooth or teeth may be flexible or rigid in differing circumstances depending on the nature of the wire—for example, whether insulated or not, and whether flexible or malleable or not. The gripping teeth can preferably grip or bite into the wire, particularly the exterior insulating coat or sheath of the wire.

In an embodiment, the at least one gripping formation can be provided as a plurality of axially spaced circumferentially running ridges having a parallelogram shaped cross-section circumferentially, the parallelogram leaning towards an end of the plug body, preferably the socket receiving end of the plug body (but this need not be the case).

In another embodiment, the at least one gripping formation can be provided as a plurality of axially spaced circumferentially running ridges having a pointed end or edge leaning towards an end of the plug body, preferably the socket receiving end of the plug body (but this need not be the case).

As mentioned above, the plug can further comprise a plug adapter that connects to, engages with, or receives the plug body and then enables the plug body to be received by a socket. The plug body can have an adapter receiving end and an adapter non-receiving end opposite the adapter receiving end.

The plug adapter can be of any suitable size, shape and construction, and can be made of any suitable material or materials. For example, the plug adapter can comprise an adapter body and a passage extending there through for receiving the plug body and wire. The adapter body can be made of any suitable non-conductive material or materials such as plastics material, rubber, carbon fibre, insulated metal or ceramics material. The adapter body can preferably be made of plastics material, and may have a Shore D hardness of approximately 85+ or 100-120R Rockwell. The passage can be of any suitable cross sectional shape, width and length.

In one embodiment the plug adapter can comprise a passage extending axially within an adapter body for receiving all or some of the plug body and a wire. The adapter body can have an outer face and an inner face that extends around the passage. The adapter body can comprise a sleeve, tube or barrel portion. The sleeve, tube or barrel portion can be of any suitable cross section, but preferably is of circular cross-section or of substantially circular cross-section. Alternatively, the adapter body (sleeve, tube or barrel portion) can be of triangular, rectangular or other geometrical cross-section. The inner and outer faces can be of similar or different cross-sections. Preferably, the adapter body is shaped to snugly receive the plug body and wire. That is, preferably the outer surface of the plug body is snugly received by the inner face/passage of the adapter body.

The adapter body can have a plug body receiving end and a wire receiving end. A part of the passage extending through the plug body receiving end can be sized to receive the plug body. A part of the passage extending through the wire receiving end can be sized to receive only the wire. That is, that part of the passage can be of smaller diameter than the part of the passage extending through the plug body receiving end.

Preferably, the adapter body comprises a barrel portion having a chamber for receiving the plug body, and a wire-receiving portion having a wire-receiving passage extending from the chamber for receiving a wire.

The connection apparatus can be used to make a connection to another wire or wires, or to an electrical appliance, equipment or device in a waterproof or fluid-tight manner in a moist or wet environment. To that end, the plug, socket and/or connection apparatus can comprise a sealing arrangement or sealing means. The sealing arrangement or sealing means can be, for example, in the form of one or more O-rings/sealing members, one or more sealing formations, and/or sealant such as chemical sealant.

For example, in some embodiments the plug can comprise at least one sealing formation extending around the inside face of the plug body, to seal against fluid (such as air or sealant as described later) from flowing between an outer periphery of the wire and the inside face. The at least one sealing formation can comprise at least one circumferentially extending ridge or tooth, preferably having a square, rectangular, triangular, rounded, tapered, wedge-shaped or pointed circumferential cross section. An inner face of each ridge/tooth or point of contact with the wire can be rounded, pointed or flat, for example. The wire can be snugly or tightly received by the sealing formation. Preferably the tooth or teeth grip or bite into the wire, particularly the exterior insulating coat or sheath of the wire.

In one embodiment the at least one sealing formation can be spaced from the at least one gripping formation, preferably away from the socket receiving end of the plug body.

In another embodiment, the at least one gripping formation can also serve as the at least one sealing formation.

For example, in some embodiments the plug or connection apparatus can comprise at least one O-ring/annular sealing member extending around the inside face of the plug body, to seal against fluid (such as air or sealant as described later) from flowing between an outer periphery of the wire and the inside face. The O-ring/annular sealing member can be located within a groove or shoulder extending along the inside face of the plug body. The O-ring/annular member can be made of rubber.

For example, in some embodiments the plug, socket or connection apparatus can comprise at least one O-ring/annular sealing member for preventing fluid from passing between the plug body or plug adapter and the socket. For example, an O-ring/annular sealing member can extend around the outside face of the plug body and seal against the socket or a groove, channel or shoulder of the socket.

For example, in some embodiments the plug adapter or connection apparatus can comprise at least one O-ring/annular sealing member extending around the inside face of the adapter body, to seal against fluid from flowing between an outer periphery of the wire and the inside face. The O-ring/annular sealing member can be located within a groove or shoulder extending along the inside face of the adapter body. The O-ring/annular member can be made of rubber.

For example, in some embodiments the plug, socket or connection apparatus can comprise at least one O-ring/annular sealing member for preventing fluid from passing between the adapter body and the socket. For example, an O-ring/annular sealing member can extend around the outside face of the adapter body and seal against the socket or a groove, channel or shoulder of the socket.

The socket can provide an electrical connection with another wire or other type of conductor, or simply help isolate/insulate an end of the wire from electrical contact or the elements, such as rain or moisture. Alternatively, the socket could be used as a means of labelling/identifying the wire/nature of the wire/intended purpose for the wire, in addition to making an electrical connection or not. That is, the sealing arrangement need not be present.

The (electrical or non-electrical) conductor can be of any suitable size, shape and construction, and can be made of any suitable material or materials. In some embodiments, the conductor can be in the form of a pin, wire or spike, of any suitable size and shape. In some embodiments, the conductor can be in the form of a plate, strip, terminal or tab, of any suitable size and shape.

In an embodiment, the socket can contain a conductor and can convert the plug assembly into a type of plug that can then be plugged into an electrical appliance, equipment or device. An electrical appliance, equipment or device (as used throughout this specification) includes, but is not limited to, anything of an electrical or electronic nature, or anything used in the transfer or transmission of data. That is, the electrical connection can be made for data transmission purposes. An electrical appliance, equipment or device (as used throughout this specification) also includes, but is not limited to, a major appliance, microcontroller, power tool or small appliance, or a component part of an electrical distribution system such as an electric switchboard, distribution board, circuit breaker or disconnect, electricity meter or transformer.

Therefore, the method according to the sixth aspect can comprise the step of using the socket containing the plug assembly (the connection apparatus) as a plug/connector to be received within a socket of an electrical appliance, equipment or device.

In another embodiment, the socket can be in the form of an opening in a circuit board or other type of electrical appliance, equipment or device for receiving the plug or plug assembly, for either isolating the wire or making an electrical connection with one or more other wires or other types of conductors. Put another way, a main body of the socket and electrical conductor etc may be provided by the electrical appliance, equipment or device itself.

Therefore, the socket can be of any suitable size, shape and construction and can be made of any suitable material or materials. For example, in an embodiment, the socket is merely an opening in an electrical appliance, equipment or device. For example, in another embodiment, the socket is in the form of a sleeve comprising a main body and a central opening for receiving the plug/plug assembly, for either isolating the wire or making an electrical connection with one or more other wires or conductors. The central opening can be blind or not.

The socket main body and end wall can be of unitary construction or comprise multiple connectable pieces. The socket main wall and end wall can be made of any suitable non-conductive material or materials such as plastics material, rubber, carbon fibre, insulated metal or ceramics material. The socket main wall and end wall can preferably be made of plastics material, and may have a Shore D hardness of approximately 85+ or 100-120R Rockwell.

In one embodiment the socket can comprise an opening extending axially within a main body for receiving the plug, preferably the socket receiving end of the plug body or preferably the plug adapter and plug body. The main body can have an outer face and an inner face that extends around the opening. The socket can comprise an end wall that borders a blind end of the opening. The main body can be in the form of a sleeve or tube having a sealed/blind end. The other end of the sleeve can be flared or the main body can have a stepped interior. The sleeve or tube can be of any suitable cross section, but preferably is of circular cross-section or of substantially circular cross-section. Alternatively, the main body (sleeve or tube) can be of triangular, rectangular or other geometrical cross-section. The inner and outer faces can be of similar or different cross-sections. Preferably, the main body is shaped to snugly receive the plug body and/or plug. That is, preferably the outer surface of the plug body is snugly received by the inner face/opening of the socket main body.

The plug can be adapted to be received within the socket in any suitable way. That is, the connection apparatus can comprise at least one male and female formation or at least one engagement formation enabling the plug body and/or plug adapter to be received within an opening in the socket and to be held or locked in place within the socket opening.

For example, the outside face of the plug body or plug adapter can have at least one male or female formation that engages at least one male or female formation of the inner face (or which are located at the inner face) of the socket main body. For example, the at least one engagement formation can comprise the outside face of the plug body or plug adapter having engagement formations for engagement with complementary engagement formations of the inner face (or which are located at the inner face) of the socket main body.

In one embodiment, the outside face of the plug body and/or plug adapter can have one or more teeth that engage one or more teeth located at the main body inner face. For example, the teeth can be in the form of a pawl and ratchet arrangement whereby the teeth of the pawl engage the ratchet teeth as the plug body or plug adapter is inserted into the socket opening. The pawl can be hinged to the main body of the socket and the teeth of the pawl can extend adjacent the inner face of the main body.

In one embodiment, the at least one engagement formation comprises a plurality of circumferentially extending grooves or slots in regular spaced relationship axially along the outside face of the plug body. Preferably, the grooves have a saw-tooth configuration and extend circumferentially such that the engagement formations and complementary engagement formations of the socket main body engage and lock together.

In another embodiment, the outside face of the plug adapter can a groove that engages one or more projections or flanges located at the main body inner face.

In an embodiment, the at least one gripping formation is preferably provided at the socket receiving end and the at least one engagement and at least one sealing formations are preferably provided at the other opposed end of the plug body.

The hinged end of the plug body can be selected as the end which is insertable into the socket, or the other end may be so selected, the at least one gripping, sealing and engagement formations being provided on the appropriate end to accommodate the selection of the insertable end.

The connection apparatus can comprise a guide for aligning the plug body with the socket main body and guiding it axially within the opening in the socket. The guide can be of any suitable form.

The guide can be in the form of the plug and socket having a keyway and key arrangement for aligning the plug body with the socket main body and guiding it axially within the opening in the socket. The guide can incorporate some of the at least one engagement formation or male and female formations as described above, but this need not be the case.

In an embodiment the socket can comprise an opening extending axially within a main body for receiving the socket receiving end of the plug body. The main body can have an outer face and an inner face that borders the opening. The socket can have an end wall that borders a blind end of the opening. The socket can comprise an electrical conductor located adjacent the end wall of the socket at the blind end of the opening, for contacting the wire located within the plug. That is, as the plug body is inserted into the opening in the socket, a conducting filament of the wire within the plug makes an electrical connection with the conductor. In one embodiment, the conductor is flat or raised and adjacent the end wall of the socket. In another embodiment, the conductor is in the form of a penetrator—spike or pin, for example—for penetrating the wire when the wire of the plug is inserted into the opening in the socket. Preferably the penetrator is capable of penetrating the external insulating coating of the wire in the event that the filament is not exposed.

The conductor, such as the penetrator, can extend through the end wall of the socket to an exterior of the socket end wall to provide another electrical point of contact. If the conductor extends to an exterior of the end wall as a pin or other point of electrical contact then the socket/connection apparatus can function as an electrical plug that can be plugged into an electrical appliance, equipment or device. That is, the plug captures an end of the wire to form a plug assembly, the plug assembly is received by the socket to make an electrical connection within the socket, and the socket itself serves as a plug that can be plugged into an electrical appliance, equipment or device so as to make another electrical contact by virtue of the exposed conductor (pin or other point of electrical contact) with the electrical appliance, equipment or device. That is, the plug and socket can serve as an adapter plug for the wire.

In another embodiment, if the wire comprises multiple spaced and insulated filaments such as in a coaxial cable, for example, the socket can comprise more than one appropriately positioned penetrator or other conductor to make more than one electrical connection with the spaced filaments of the wire.

If a non-electrical connection is required (eg. when merely isolating the end of the wire), the socket can be devoid of any electrical conductor adjacent the end wall of the socket.

As mentioned the connection apparatus can be used to make a connection to another wire or wires, or to an electrical appliance, equipment or device in a waterproof or fluid-tight manner in a moist or wet environment. In one embodiment, the socket can comprise a sealing arrangement or sealing means in the form of a sealant or sealants located within the socket, and the plug body can comprise at least one vent for venting air and for receiving some of the sealant/s when the socket receiving end of the plug body is brought into contact with the sealant/s and displaces the sealant/s. In this way, the point of electrical contact can be rendered fluid-tight, especially watertight. Preferably the sealant/s is located at or within the blind end of the opening adjacent the socket end wall.

Any suitable type of sealant/s can be used. The sealant/s may set, for example, when exposed to air, moisture, light or heat, or when different sealant components mix with one another. Suitable sealants include non-conductive sealants that coat an end of the wire and stick to the plug body and socket main body, although binding with the bodies may not be essential. Suitable sealants include those that have adhesive properties. Preferably the sealant/s is free flowing and hardens when exposed to air or when two sealant components are mixed together.

The term 'sealant' as defined herein is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives (eg. solvent based adhesives and polymer dispersion adhesives), contact adhesives (eg. natural rubber and polychloroprene), one-part adhesives (eg. cyanoacrylates and urethanes) and multi-part adhesives (polyester resin-polyurethane resin, polyols-polyurethane resin, and acrylic polymers-polyurethane resins).

The socket can include at least one rupturable isolated chamber/cavity or at least one rupturable membrane, seal or bladder for compartmentalising the sealant from exposure to air or moisture or light, for example. Upon rupture and exposure to air, moisture or light, the sealant can cure/harden.

The socket can include one or more isolated chambers, rupturable membranes, seals or bladders for compartmentalising two sealant components from one another, for example. Upon rupture, the sealant components can mix, chemically react, and cure/harden. In one embodiment, one or more chambers, membranes, seals or bladders containing sealant/s (settable materials) can be disposed about the at least one conductive penetrator or other conductor within the blind end of the opening adjacent the end wall of the socket. The penetrator can be located externally of the chamber, membrane, seal or bladder, or a wire penetrating end of the penetrator can be located within the chamber, membrane, seal or bladder.

The rupturable membrane or bladder can be annular (in the shape of a donut) and can be placed in the blind end of the opening such that the conductor/penetrator extends through a central opening in the chamber, membrane, seal or bladder.

The at least one vent can comprise a gap or channel extending between the outside face of the plug body and main body (inner face) of the socket, linking the blind end of the opening/sealant to the atmosphere. Gaps or channels can extend along opposed longitudinal sides of the outside face to the blind end of the opening/sealant.

The connection apparatus can comprise at least one piercer for piercing a wall of the isolated chamber, membrane, seal or bladder containing the sealant/settable material. Either the plug or the socket can comprise the piercer. The piercer can be of any suitable size, shape and construction. The plug or socket can have more than one piercer.

For example, the hinge or hinges of the plug body having a pointed edge (fold line) extending toward the blind end of the opening in the socket can function as a piercer or piercers. Such a piercer (or piercers) can be received within a recess or groove extending within the end wall of the socket.

For example, one or more piercers can extend from the socket receiving end of the plug body. Such piercers can be received within a recess or groove extending within the end wall of the socket. The recess or groove can be circular or annular.

For example, one or more piercers can extend alongside or within the isolated chamber or rupturable membrane/bladder etc or sealed sealant/settable material. Such piercers can be received within a recess or groove extending within the socket receiving end of the plug body. The recess or groove can be annular.

It is possible that the penetrator, if fully located within the isolated chamber, membrane, seal or bladder, can both rupture and penetrate the wire as the socket receiving end is forced against the isolated chamber wall, membrane, seal or bladder.

Preferably, the plug is of unitary construction and is made of plastics material, and may have a Shore D hardness of approximately 85+ or 100-120R Rockwell.

The connection apparatus can comprise other components such as, for example, a closure for isolating or enclosing an end of the wire. The closure can be, for example, a cap or cover that friction fits or screws to the plug and/or socket. Preferably the closure is a cap that extends over an end of the plug and friction fits to the outer face of the main body of the socket.

In an embodiment the conductor of the socket can make electrical contact with any suitable number of conductors (wires or other types of conductors). Any suitable number includes 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100.

In an embodiment, the socket can have diametrically opposed blind openings separated by a common end wall (median wall). Such an embodiment could receive a respective plug/plug assembly within each opening to electrically connect two wires together. That is, the socket can be in the form of a dual socket for connecting two wires together, said dual socket comprising essentially two said sockets connected at their said end walls, and the penetrator of both sockets is connected together.

If the dual socket is to be waterproof, each socket can comprise a sealant (contained within a rupturable membrane, bladder or chamber or contained by a seal, or not) and/or a sealing member or sealing means, such as an O-ring.

In another embodiment, the socket can have more than two, three, four or five blind openings for receiving more than two, three, four or five plugs/plug assemblies.

In another embodiment, the socket can have any suitable number of blind openings for receiving any suitable number of plugs/plug assemblies. For example, the one socket can be electrically connected to 1, 2, 3, 4, 5, 6, 7, 8, 9, 10, about 15, about 20, about 25, about 30, about 35, about 40, about 45, about 50, about 55, about 60, about 65, about 70, about 75, about 80, about 85, about 90, about 95, about 100 (and any number in between 10-100) and more than 100. Preferably, the sockets are connected by their end walls or by way of an additional connector region, branched body or webbing, and the conductors/penetrators of the sockets are connected together.

In an embodiment, the socket can be in the form of a socket assembly for connecting two or more wires or other types of conductors together, said socket assembly comprising two or more said sockets electrically connected together.

According to a seventh aspect of the present invention, there is provided a dual socket assembly for connecting two wires or other types of conductors together, said dual socket assembly comprising two said sockets as defined according to the fourth aspect of the invention electrically connected together and capable of receiving two plugs or plug assemblies as defined according to the first, second or third aspects of the invention.

According to an eighth aspect of the present invention, there is provided a socket assembly for connecting a plurality of wires or other types of conductors together, said socket assembly comprising a plurality of sockets as defined according to the fourth aspect of the invention electrically connected together and capable of receiving a plurality of plugs or plug assemblies as defined according to the first, second or third aspects of the invention.

The connection apparatus can comprise a guide for aligning the plug body with the socket main body and guiding it axially within the opening in the socket. The guide can be of any suitable form.

The guide can be in the form of the plug and socket having a keyway and key arrangement for aligning the plug body with the main adapter body and guiding it axially within the opening in the main adapter body. The guide can incorporate some of the at least one engagement formation or male and female formations as described above, but this need not be the case.

According to a preferred ninth aspect of the present invention, there is provided a plug adapted to hold a wire and to be received within a socket, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; and a wire-receiving portion comprising a wire-receiving passage for receiving the wire, such that when the plug adapter houses the plug body the plug is receivable within a socket.

In a preferred embodiment, the plug adapter can seal the plug body within the socket and render the connection watertight (fluid-tight).

According to a preferred tenth aspect of the present invention, there is provided a plug adapted to hold a wire and to be received within a socket in a fluid-tight manner, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; a wire-receiving portion comprising a wire-receiving passage for receiving the wire; and a sealing arrangement such that when the plug adapter houses the plug body and the plug is received by a socket, the plug body is sealed within the socket in a fluid-tight manner.

According to an eleventh aspect of the present invention, there is provided a connection apparatus comprising the plug of the ninth or tenth aspect and a socket for receiving the plug.

According to a twelfth aspect of the present invention, there is provided a method of forming an electrical connection comprising the steps of: locating a wire within a plug as defined according to the ninth or tenth aspect; and receiving the plug within a socket comprising an electrical conductor.

According to a thirteenth aspect of the present invention, there is provided a dual socket assembly for connecting two wires or other types of conductors together, said dual socket assembly comprising two sockets electrically connected together and capable of receiving two plugs as defined according to the ninth or tenth aspect.

According to a fourteenth aspect of the present invention, there is provided a socket assembly for connecting a plurality of wires or other types of conductors together, said socket assembly comprising a plurality of sockets electrically connected together and capable of receiving a plurality of plugs as defined according to the ninth or tenth aspect.

Features of any of these aspects can be as described for the earlier aspects of the invention.

The barrel portion can be of any suitable size, shape and construction. The barrel portion can comprise a barrel wall that surrounds the chamber. The plug body can be completely or partially housed within the chamber. Preferably, all but an enlarged end of the plug body is housed within the chamber.

The wire-receiving portion can be of any suitable size, shape and construction. The wire-receiving portion can comprise an enlarged end, comprising a circumferentially extending flange and/or a cuboid, rectangular prism or cylindrical body enabling gripping by fingers or a pair of pliers, for example.

Any suitable type of sealing arrangement can be used. In one embodiment, the sealing arrangement can comprise one, two or more sealing members, such as O-rings, being preferably made of rubber. In another embodiment, the sealing arrangement can comprise at least one sealing formation integrally formed with the plug body, as described earlier herein.

A first sealing member can extend around the wire adjacent the plug adapter engaging end between the chamber and the wire-receiving passage, for preventing fluid (gas, liquid or particulate matter) movement from the wire-receiving passage to the plug body. The first sealing member can be an O-ring located within a groove, space or cavity of the plug adapter located adjacent the chamber.

A second sealing member can extend around the barrel wall, between the barrel wall and socket, for preventing the entry of fluid into the socket. The second sealing member can be an O-ring extending around the barrel wall adjacent the wire-receiving portion, and is locatable within a groove, cavity or shoulder of the socket main body.

Preferably the plug adapter is of unitary construction, but with possible exception if the sealing arrangement comprises one or more O-rings.

The plug adapter can optionally comprise at least one sealing formation extending around the inside face of the plug body, to further seal against fluid from flowing between an outer periphery of the wire and the inside face. The at least one sealing formation can comprise at least one circumferentially extending ridge or tooth that engages the wire. The at least one sealing formation can be spaced from the at least one gripping formation, near to the plug adapter engaging end.

The plug body can taper or narrow in an axial direction from the enlarged end to the plug adapter receiving end. In a similar manner, the chamber can narrow in an axial direction from the enlarged end to the adapter receiving end.

Preferably the plug body clamps to and retains the wire within the passage when the plug adapter engaging end of the plug body has been received within the chamber.

Preferably the plug body comprises an inside face and an outside face, and the plug further comprises at least one gripping formation extending inwardly from the inside face for gripping the wire when located within the passage. Preferably the at least one gripping formation comprises one or more gripping teeth extending along the inside face of the plug body that are pointed in a direction that prevents or minimises the risk of the wire being pulled out of the passage in an axial direction. Preferably the gripping teeth point away from the plug adapter engaging end. Preferably the gripping teeth grip or bite into an exterior insulating coat or sheath of the wire.

Preferably the plug body comprises two plug body portions that are hinged together and are moveable together via a hinge into the second clamping configuration. Preferably the plug body comprises two substantially identical body portions hinged together at an end of the plug body using at least one hinge. Preferably one or more hinges are located at an enlarged end of the plug body. Preferably the substantially identical body portions resemble a sleeve or tube split into longitudinal halves and are hinged at an end of the sleeve or tube.

Preferably the passage extends centrally along a longitudinal axis of the plug body completely through the plug body.

Preferably the connection apparatus comprises at least one engagement formation enabling the plug adapter to be received within the opening in the socket and to be held or locked in place within the opening. Preferably the at least one engagement formation comprises a female formation engaging a male formation. For example, a male formation can extend from the main body and be received within a female formation of the plug adapter wire-receiving portion, preferably being a groove extending within a flange or tab of the wire-receiving portion.

Preferably the connection apparatus comprises at least one engagement formation enabling the plug body to be received within the chamber and to be held or locked in place within the chamber. Preferably the at least one engagement formation comprises a female formation engaging a male formation. For example, a male formation can extend from the plug body and be received within a female formation of the plug adapter, preferably being a groove extending within the barrel wall.

As already mentioned, any of the features described herein or as defined in the paragraphs above or below can be combined in any combination with any one or more of the other features described herein within the scope of the invention.

In a further aspect the present invention resides broadly in a waterproof connection apparatus including a plug assembly (described elsewhere in this specification as a plug) engageable with a socket assembly (described elsewhere in this specification as a socket), the plug assembly including: a sleeve body (described elsewhere in this specification as a plug body) being provided in two or more parts engageable with one another to form a wall surrounding a passage passing through the sleeve body, the wall having an inside face and an outside face; one or more gripping formations extending inwardly from the inside face of the wall for gripping a cable or the insulation thereof (described elsewhere in this specification as a wire) when introduced into the passage; and engagement formations about the outside face of the wall for engagement with complementary engagement formations of the socket assembly, the socket assembly including: a main body; a socket (described elsewhere in this specification as an opening) formed into the main body to receive the plug assembly and having a conductive spike (described elsewhere in this specification as a penetrator) arranged at a disposition within the socket for electrical contact with the cable of the plug assembly and a rupturable membrane disposed about the spike to provide an annular cavity within the membrane, the annular cavity having therein a liquid material (described elsewhere in this specification as a sealant) settable upon rupturing of the membrane, the parts being so arranged to provide a gap (described elsewhere in this specification as a vent) between the plug assembly and at least some of the socket to receive the settable liquid upon rupturing of the membrane.

In a further aspect, the present invention resides broadly in a plug assembly (described elsewhere in this specification as a plug) for securing conductors to an electrical connector comprising: a sleeve body (described elsewhere in this specification as a plug body) being provided in two or more parts engageable with one another to form a wall surrounding a passage passing through the sleeve body, the wall having an inside face and an outside face; one or more gripping formations extending inwardly from the inside face of the wall for gripping a cable or the insulation thereof (described elsewhere in this specification as a wire) when introduced into the passage; and engagement formations about the outside face of the wall for engagement with complementary engagement formations of a socket assembly (described elsewhere in this specification as a socket) as hereinbefore described.

In a further aspect, the present invention resides broadly in a socket assembly (described elsewhere in this specification as a socket) comprising: a main body; a socket (described elsewhere in this specification as an opening) formed into the main body to receive a plug assembly (described elsewhere in this specification as a plug) as hereinbefore described and having a conductive spike (described elsewhere in this specification as a penetrator) arranged at a disposition within the socket for electrical contact with the cable (described elsewhere in this specification as a wire) of the plug assembly and a rupturable membrane disposed about the spike to provide an annular cavity within the membrane, the annular cavity having therein a liquid material settable (described elsewhere in this specification as a sealant) upon rupturing of the membrane, the parts being so arranged to provide a gap (described elsewhere in this specification as a vent) between the plug assembly and at least some of the socket to receive the settable liquid upon rupturing of the membrane.

In a further aspect, the present invention resides broadly in a rupturable membrane having an annular cavity formed for placement in a socket about a spike (described elsewhere in this specification as a conductive penetrator) to form the socket assembly (described elsewhere in this specification as a socket) as hereinbefore described.

In a further aspect, the present invention resides broadly in an apparatus for conductively connecting one or more cables to one another in a waterproof manner, the apparatus comprising: a non-conductive connector housing having an open end, an opposing end and a passage extending through the housing from the open end to the opposing end; a conductive spike disposed within the housing extending into the passage intermediate the open and the opposing ends; a membrane disposed within the passage about the conductive spike and defining an annular chamber between the pin and the housing; and a liquid sealant substantially filling said annular chamber.

Preferably, the sleeve body is provided in two parts connected to one another by a hinge connection at one end to provide a hinged end and an open end. Each part is substantially identical, being substantially semicircular in cross-section so that, when the hinge is closed along with the gap between the parts, the passage penetrates the entire length of the sleeve body.

Preferably, the sleeve body is formed from rigid plastics material of a kind which permits a live hinge comprising the plastics material to be provided for the hinge connection between the two parts.

Preferably, sealing formations are provided about the inner face of the passage spaced from the other end of the sleeve body from which the gripping formations are provided.

Preferably, the sealing formations are provided in the form of a plurality of circumferentially running ridges or teeth preferably having a square, rectangular, wedge-shaped, tapered, triangular or pointed circumferential cross section. An inner face of each ridge/tooth or point of contact with the wire can be rounded, pointed or flat, for example. The wire can be snugly or tightly received by the sealing formation. Preferably the ridges or teeth grip or bite into the wire, particularly the exterior insulating coat or sheath of the wire.

The gripping formations are provided on the end of the sleeve body which is insertable into the socket and the engagement and sealing formations are provided on the other end.

The hinged end may be selected as the end which is insertable into the socket, or the other end may be so selected, the gripping, sealing and engagement formations being provided on the appropriate end to accommodate the selection of the insertable end.

Preferably, the conductive spike is supported by a median wall substantially closing the passage intermediate the ends of the connector housing. Preferably, cable guides are included at the open end of the connector housing extending radially inward to engage a plug assembly as hereinbefore described having the wire passing through the passage of the sleeve to form the plug assembly, or a cable introduced directly into the non-conductive connector housing. In one form, the cable guides include a plurality of inwardly directed barbs. Preferably, the cable guides constitute a plurality of complementary engagement formations each in the form of a pawl member, the saw-tooth profile of the engagement formations of the plug assembly constituting a ratchet by which the plug assembly once inserted into the socket assembly is substantially non-removable by virtue of the ratchet and pawl action of the engagement and complementary engagement formations respectively.

Preferably, the liquid sealant is air-activated. Insertion of a wire or a sleeve-encased wire into the open end of the connector housing and into contact with the pin punctures provides electrical connection. The wire or sleeve encased wire may be further inserted with force sufficient to rupture the membrane causing at least some of the liquid sealant to exit from the annular chamber around the wire and pin and set to form a non-conductive plug.

The connector of U.S. Pat. No. 7,211,725 may be considered as a socket for the plug of the present invention. The sealant may be activated by a catalyst, setting compound or other substance if desired.

This aspect of the invention has particular application to making electrical connections in respect of conductors, such as electrical wires, to appliances in a waterproof manner in a moist or wet environment. However, this aspect of the invention has application to making electrical connections in environments which do not require water proofing. This aspect of the invention may also have application to making connections using the electrical connector described in U.S. Pat. No. 7,211,725 and improvements to that connector, hereinafter referred to as the patented connector. However, it will be appreciated that this aspect of the invention is not limited to connection of conductors to or using the patented connector.

Particularly preferred embodiments of the invention are defined in the paragraphs below.

1. A plug adapted to hold a wire and to be received within a socket, said plug comprising a plug body and a passage extending axially within the plug body for receiving a wire, wherein the plug body is configurable in a first wire-receiving configuration so that a wire can be placed within the passage and a second clamping configuration so that the plug body can clamp to and retain the wire within the passage.

2. The plug of paragraph 1, wherein the plug body clamps to and retains the wire within the passage when a socket receiving end of the plug body has been received within a socket.

3. The plug of paragraph 1 or paragraph 2, wherein the passage extends centrally along a longitudinal axis of the plug body completely through the plug body (and optionally through a socket receiving end of the plug body).

4. The plug of paragraph 2 or paragraph 3, wherein the plug body comprises an inside face and an outside face, and the plug further comprises at least one gripping formation extending inwardly from the inside face for gripping the wire when located within the passage.

5. The plug of paragraph 4, wherein the at least one gripping formation comprises one or more gripping teeth extending along the inside face of the plug body that are pointed in a direction that prevents or minimises the risk of the wire being pulled out of the passage in an axial direction.

6. The plug of paragraph 5, wherein the gripping teeth grip or bite into an exterior insulating coat or sheath of the wire.

7. The plug of any one of paragraphs 4 to 6 further comprising at least one sealing formation extending around the inside face of the plug body, to seal against fluid from flowing between an outer periphery of the wire and the inside face.

8. The plug of paragraph 7, wherein the at least one sealing formation comprises at least one circumferentially extending ridge or tooth that engages the wire.

9. The plug of paragraph 7 or paragraph 8, wherein the at least one sealing formation is spaced from the at least one gripping formation, away from the socket receiving end of the plug body.

10. The plug of any one of paragraphs 2 to 9, wherein the plug body comprises two plug body portions that are hinged together and are moveable together via a hinge into the second clamping configuration.

11. The plug of paragraph 10, wherein the plug body comprises two substantially identical body portions hinged together at an end of the plug body using at least one hinge.

12. The plug of paragraph 11, wherein the substantially identical body portions resemble a sleeve or tube split into longitudinal halves and hinged at an end of the sleeve or tube.

13. The plug of any one of paragraphs 1 to 12, wherein the plug is of unitary construction, preferably being made of plastics material.

14. A connection apparatus comprising the plug of any one of paragraphs 1 to 13 and a socket for receiving the plug.

15. The connection apparatus of paragraph 14, wherein the socket is an opening in an electrical appliance, equipment or device.

16. The connection apparatus of paragraph 14, wherein the socket comprises an opening extending axially within a main body for receiving the plug.

17. The connection apparatus of paragraph 16, wherein the main body comprises an outer face, an inner face that extends around the opening and an end wall that borders a blind end of the opening.

18. The connection apparatus of paragraph 17, wherein the main body is in the form of a sleeve or tube having a sealed or blind end.

19. The connection apparatus of paragraph 17 or paragraph 18, wherein the apparatus comprises at least one engagement formation enabling the plug body to be received within the opening in the socket and to be held or locked in place within the opening.

20. The connection apparatus of paragraph 19 when dependent on any one of paragraphs 4 to 9, wherein the at least one engagement formation comprises the outside face of the plug body comprising teeth that engage further teeth of the at least one engagement formation located at the main body inner face.

21. The connection apparatus of paragraph 19 or paragraph 20, wherein the teeth of the at least one engagement formation are in the form of a pawl and ratchet arrangement whereby the teeth of the pawl engage the ratchet teeth as the plug body is inserted into the socket opening.

22. The connection apparatus of paragraph 19 when dependent on any one of paragraphs 4 to 9, wherein the at least one engagement formation comprises the outside face of the plug body comprising a plurality of circumferentially extending formations in regular spaced relationship axially along the outside face of the plug body that engage complementary formations of the at least one engagement formation located at the main body inner face.

23. The connection apparatus of any one of paragraphs 16 to 22 further comprising a guide for aligning the plug body with the socket main body and guiding it axially within the opening in the socket.

24. The connection apparatus of paragraph 23, wherein the guide is in the form of the plug and socket having a keyway and key arrangement for aligning the plug body with the socket main body and guiding it axially within the opening in the socket.

25. The connection apparatus of any one of paragraphs 17 to 22, wherein the socket comprises an electrical conductor located adjacent the end wall of the socket at the blind end of the opening, for contacting the wire located within the plug.

26. The connection apparatus of paragraph 25, wherein the conductor is in the form of a penetrator for penetrating the wire when the wire of the plug is inserted into the opening in the socket.

27. The connection apparatus of paragraph 26, wherein the conductor or penetrator extends through the end wall of the socket to an exterior of the socket end wall to provide another electrical point of contact.

28. The connection apparatus of paragraph 27, wherein the socket of the connection apparatus functions as an electrical plug that can be plugged into an electrical appliance, equipment or device.

29. The connection apparatus of any one of paragraphs 26 to 28, wherein the socket comprises a sealant located at the blind end of the opening, and the plug body comprises at least one vent for venting air and for receiving at least some of the sealant when the socket receiving end of the plug body is brought into contact with the sealant and displaces the sealant.

30. The connection apparatus of paragraph 29, wherein the sealant sets when exposed to air and renders a connection between the wire and conductor waterproof.

31. The connection apparatus of paragraph 29 or paragraph 30, wherein the socket comprises at least one rupturable membrane or bladder that contains the sealant.

32. The connection apparatus of paragraph 31, wherein the at least one rupturable membrane or bladder is disposed about the penetrator within the blind end of the opening.

33. The connection apparatus of any one of paragraph 29 to 32, wherein the at least one vent comprises a channel extending between the outside face of the plug body and main body of the socket, linking the blind end of the opening to the atmosphere.

34. The connection apparatus of paragraph 33, wherein two said channels extend along opposed longitudinal sides of the outside face to the blind end of the opening.

35. The connection apparatus of any one of paragraphs 31 to 34 further comprising at least one piercer for piercing a wall of the rupturable membrane or bladder containing the sealant.

36. The connection apparatus of claim 35, wherein the at least one piercer extends from the socket receiving end of the plug.

37. The connection apparatus of paragraph 35, wherein the at least one piercer extends from the end wall of the main body.

38. The connection apparatus of any one of paragraphs 25 to 37, wherein the socket is in the form of a dual socket for connecting two wires together, said dual socket comprising essentially two said sockets connected at their said end walls, and the conductor of both sockets is connected together.

39. The connection apparatus of any one of paragraphs 25 to 37, wherein the socket is in the form of a socket assembly for connecting many wires together, said socket assembly comprising a plurality of said sockets electrically connected together.

40. The connection apparatus of any one of paragraphs 14 to 39, wherein said connection apparatus provides a fluid-tight connection.

41. A method of forming an electrical connection comprising the steps of: locating a wire within a plug as defined in any one of paragraphs 1 to 13; and receiving the plug within a socket comprising an electrical conductor.

42. A socket as described in any one of paragraphs 14 to 37 and 40, or a dual socket as described in paragraph 38, or a socket assembly as described in paragraph 39.

43. A dual socket assembly for connecting two wires or other types of conductors together, said dual socket assembly comprising two sockets as described in any one of paragraphs 14 to 38 electrically connected together and capable of receiving two plugs as defined in any one of paragraphs 1 to 13.

44. A socket assembly for connecting a plurality of wires or other types of conductors together, said socket assembly comprising a plurality of sockets as described in any one of paragraphs 14 to 37 or 39 electrically connected together and capable of receiving a plurality of plugs as defined in any one of paragraphs 1 to 13.

Yet further particularly preferred embodiments of the invention are defined in the paragraphs below.

1. A plug adapted to hold a wire and to be received within a socket, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; and a wire-receiving portion comprising a wire-receiving passage for receiving the wire, such that when the plug adapter houses the plug body the plug is receivable within a socket.

2. A plug adapted to hold a wire and to be received within a socket in a fluid-tight manner, said plug comprising:

a plug body comprising: a plug adapter engaging end; and a passage extending axially within the plug body for receiving a wire, wherein the plug body is configurable in a first wire-receiving configuration so that a wire can be placed within the passage and extend from the plug adapter engaging end of the plug body, and a second clamping configuration so that the plug body can clamp to and retain the wire within the passage; and a plug adapter comprising: a barrel portion comprising an open-ended chamber for receiving and housing the plug body; a wire-receiving portion comprising a wire-receiving passage for receiving the wire; and a sealing arrangement such that when the plug adapter houses the plug body and the plug is received by a socket, the plug body is sealed within the socket in a fluid-tight manner.

3. A connection apparatus comprising the plug of paragraph 1 or paragraph 2 and a socket for receiving the plug.

4. A method of forming an electrical connection comprising the steps of: locating a wire within a plug as defined according to paragraph 1 or paragraph 2; and receiving the plug within a socket comprising an electrical conductor.

5. A dual socket assembly for connecting two wires or other types of conductors together, said dual socket assembly comprising two sockets electrically connected together and capable of receiving two plugs as defined according to paragraph 1 or paragraph 2.

6. A socket assembly for connecting a plurality of wires or other types of conductors together, said socket assembly comprising a plurality of sockets electrically connected together and capable of receiving a plurality of plugs as defined according to paragraph 1 or paragraph 2.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of figures as follows:

BRIEF DESCRIPTION OF FIGURES

Various embodiments of the invention will be described with reference to the following figures, in which.

DETAILED DESCRIPTION OF EMBODIMENTS

Figure 1:
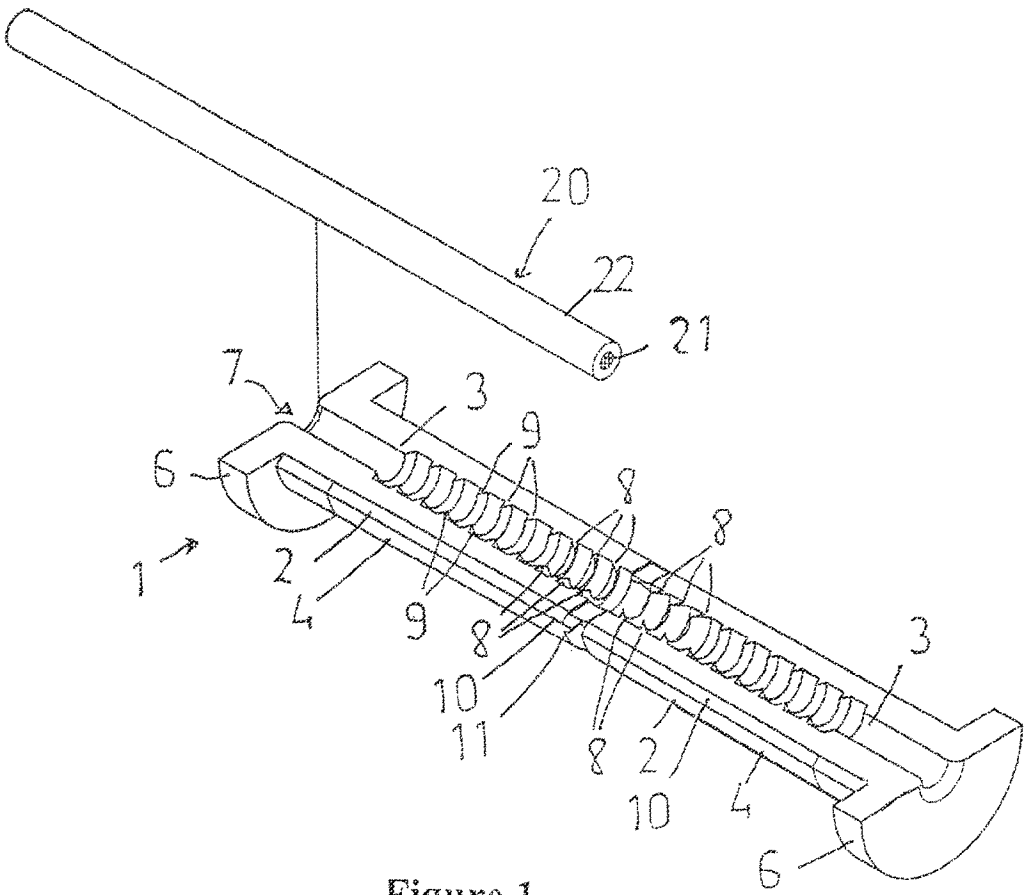
FIG. 1 is an exploded isometric view of a wire and a plug in a wire-receiving configuration, according to an embodiment of the invention.
Figure 2:
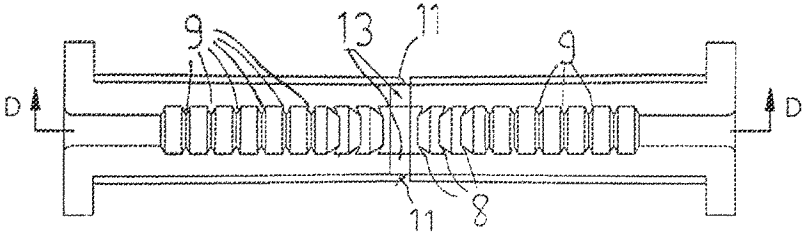
FIG. 2 is a top view of the plug shown in FIG. 1.
Figure 3:
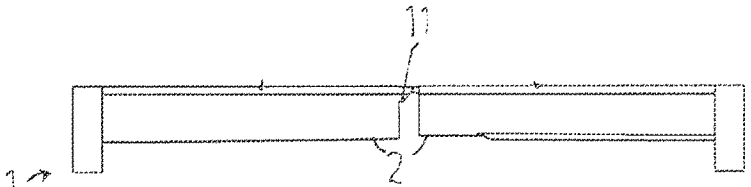
FIG. 3 is a front view of the plug shown in FIG. 1.
Figure 4:
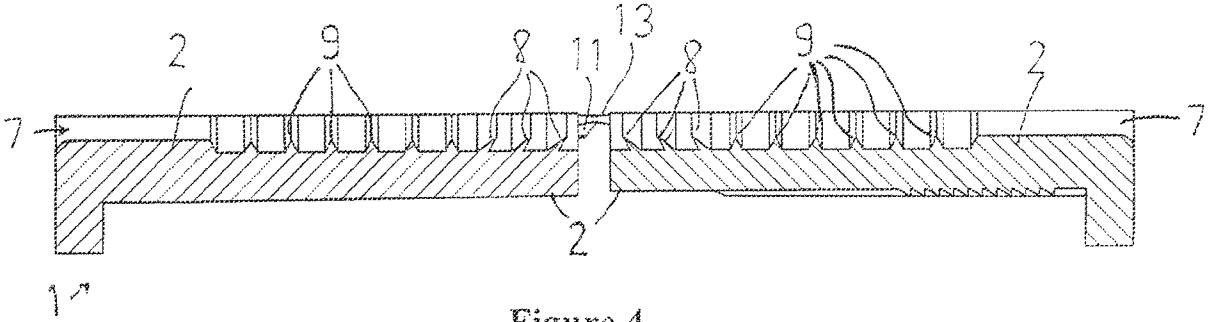
FIG. 4 is a section view of the plug shown in FIG. 2, taken through plane D-D.

In the figures like reference numerals refer to like features (eg. 1*a* and 1*b* are like features).

The figures show different types of connection apparatuses generally comprising different types of plugs and sockets, wherein each plug can clamp a wire and be retained within a general socket of sorts.

Figure 17:
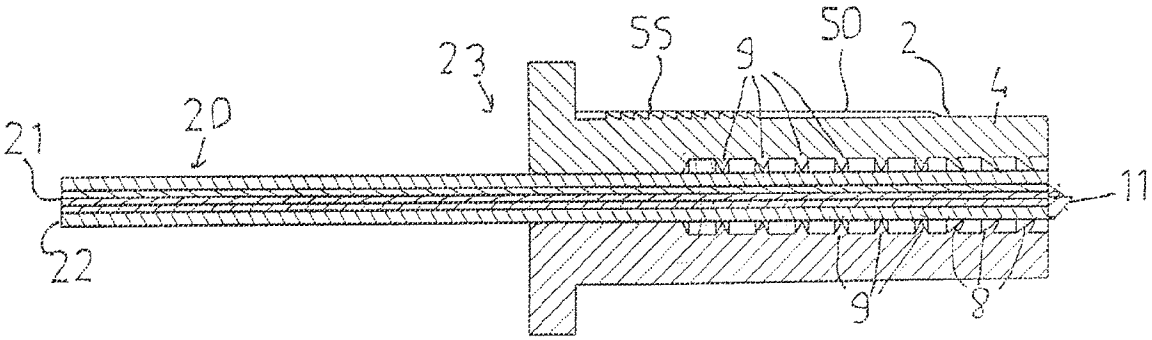
FIG. 17 is a section view of that shown in FIG. 13, taken through plane E-E.
Figure 18:
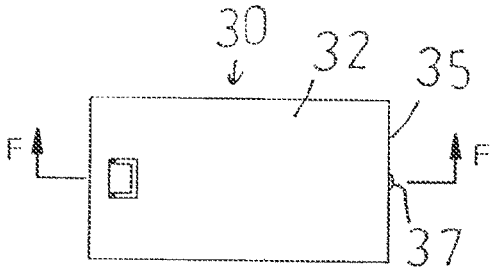
FIG. 18 is a top view of the socket shown in FIG. 9.
Figure 19:
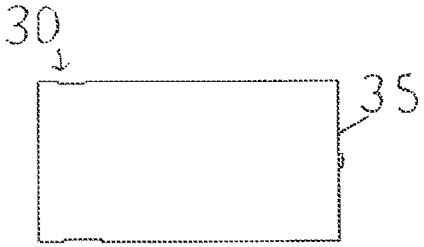
FIG. 19 is a front view of the socket shown in FIG. 18.

Referring first to FIGS. 1-17, there is shown a plug 1 for clamping a wire 20, that together with the wire 20 form a plug assembly 23 as seen in FIGS. 13 to 17, according to an embodiment of the invention. The wire 20 in this example has a conductive filament interior 21 and an insulating sheathed exterior 22, as best seen in FIGS. 1 and 17.

Figure 5:
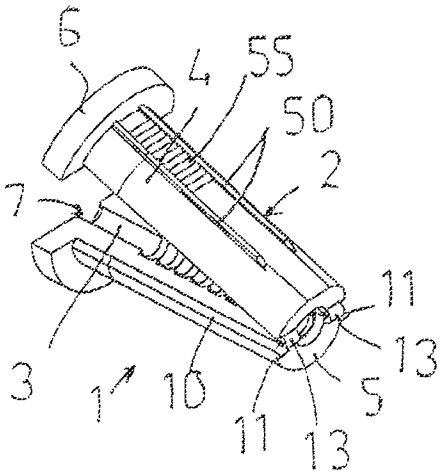
FIG. 5 is an isometric view of the plug shown in FIG. 1, but shown in a different configuration.
Figure 6:
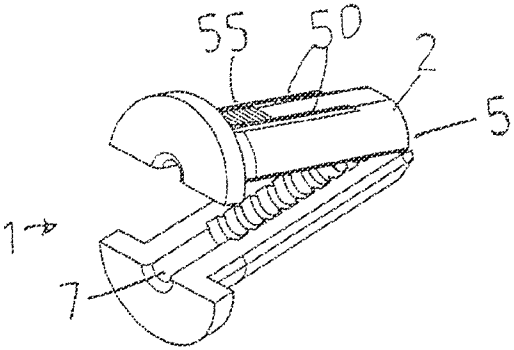
FIG. 6 is another isometric view of the plug shown in FIG. 5.
Figure 7:
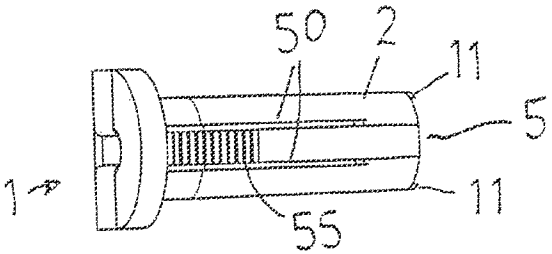
FIG. 7 is a top view of the plug shown in FIG. 5.
Figure 8:
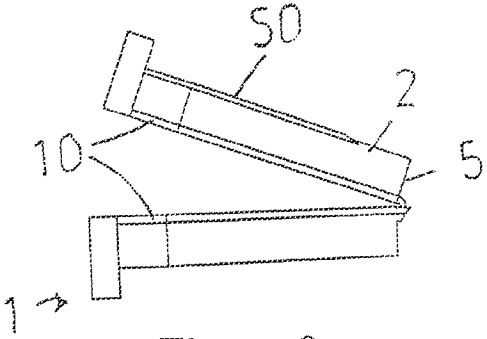
FIG. 8 is a front view of the plug shown in FIG. 5.
Figure 9:
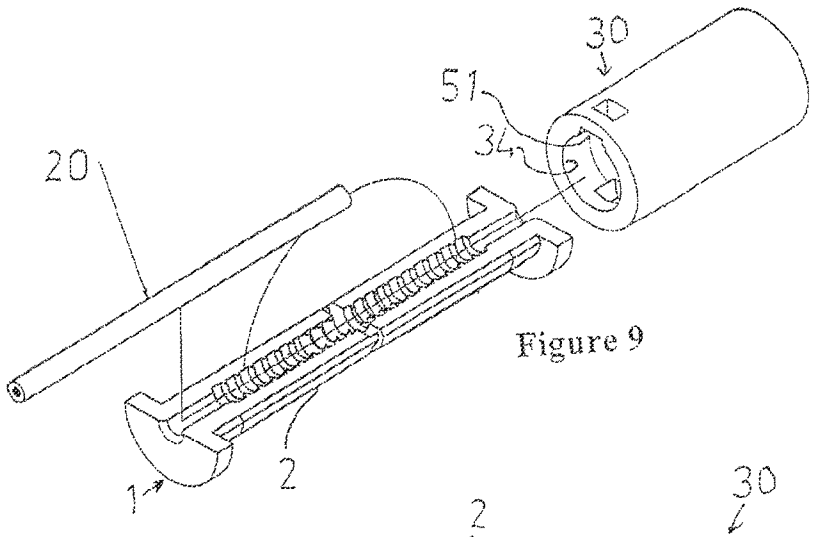
FIG. 9 is an exploded isometric view of the wire and plug shown in FIG. 1 and a socket, together forming an electrical connection apparatus, according to an embodiment of the invention.
Figure 10:
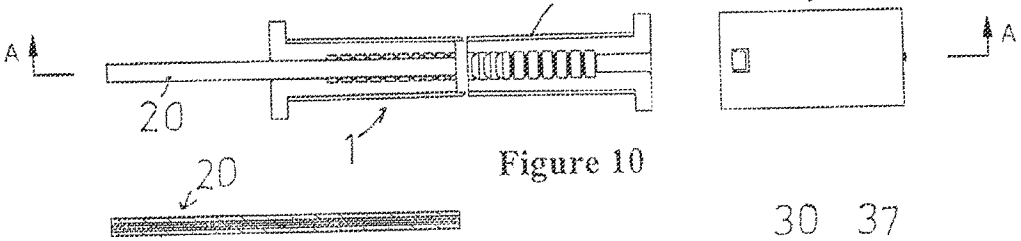
FIG. 10 is a top view of that shown in FIG. 9.
Figure 11:
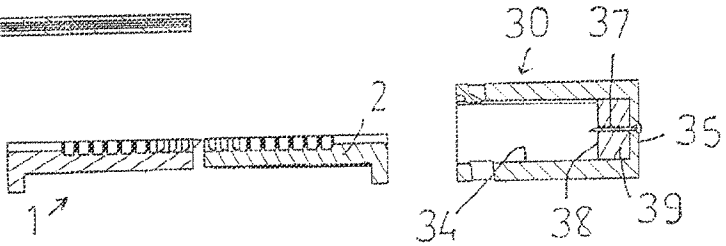
FIG. 11 is a section view of that shown in FIG. 10, taken through plane A-A.
Figure 12:
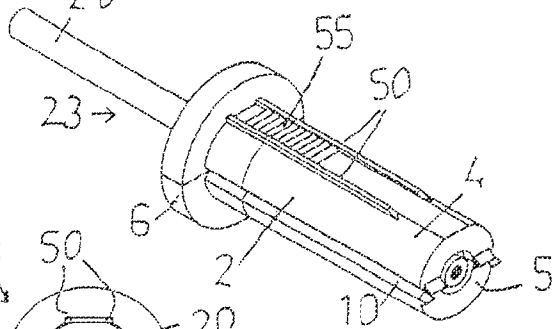
FIG. 12 is an isometric view of the plug shown in FIG. 1 but shown in a wire-clamping configuration, whereby the wire of FIG. 1 is clamped by the plug to form a plug assembly.
Figure 15:
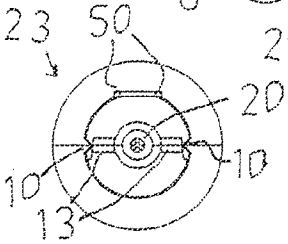
FIG. 15 is a right view of that shown in FIG. 12.
Figure 13:
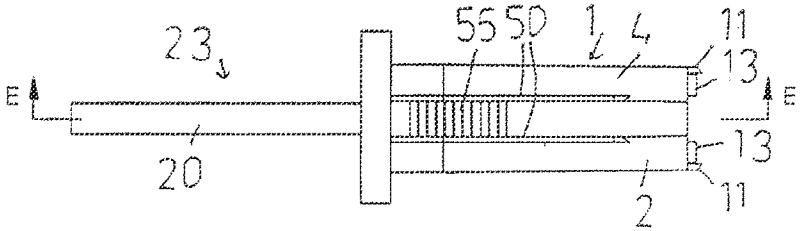
FIG. 13 is a top view of that shown in FIG. 12.
Figure 14:
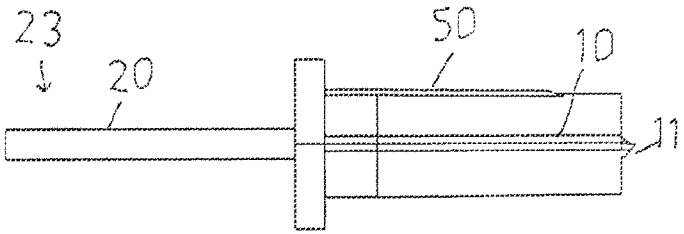
FIG. 14 is a front view of that shown in FIG. 12.
Figure 16:
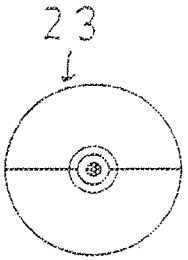
FIG. 16 is a left view of that shown in FIG. 12.

As seen in FIGS. 1, 5 and 12, the plug 1 includes a plug body 2 having an inside face 3, an outside face 4, a socket receiving end 5 (plug end wall 5) and an enlarged head (flange) 6 at an opposing end. The plug 1 includes a passage 7 extending axially through the plug body 2, including the plug end wall 5, for snugly receiving a wire 20, a gripping formation 8 extending inwardly from the inside face 3 for gripping the wire 20 when located within the passage 7, a sealing formation 9 extending around the inside face 3 of the plug body 2 to seal against fluid (such as air or sealant as described later) from flowing between an outer periphery of the wire 20 and the inside face 3, a vent 10 (for air or sealant as described later), and two piercers 11.

The passage 7 extends centrally along a longitudinal axis of the plug body 2, completely through the plug body 2, including the plug end wall/socket receiving end 5.

Alternatively, an end of the passage 7 at the socket receiving end 5 could be blind or substantially blind, so as to completely or substantially isolate and insulate an end of the wire 20 for a non-electrical connection with the socket. If blind, the socket can simply help isolate an end of the wire from electrical contact or the elements, such as rain or moisture. Alternatively, the socket could be used as a means of labelling/identifying the wire/nature of the wire/intended purpose for the wire.

The diameter of the passage 7 will vary in accordance with the gauge of the wire, such that the fit is snug.

The gripping formation 8 has tapered teeth (barbs) extending as circumferential pointed ridges around the inside face 3, and spaced apart from one another along the inside face 3 relative to the longitudinal axis (not all of the teeth 8 have been labelled). Sharp edges of the teeth 8 are pointed towards the socket receiving end 5 so as to prevent or minimise the risk of the wire 20 being pulled out of the passage 7 in an axial direction.

Figure 43:
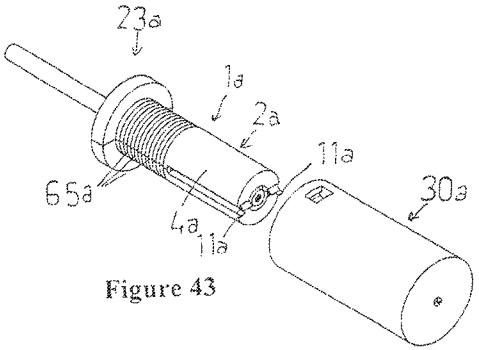
FIG. 43 is an isometric view of a connection apparatus like that shown in FIG. 25, except that the plug and socket differ slightly from those shown in FIG. 25, according to another embodiment of the invention.
Figure 42:
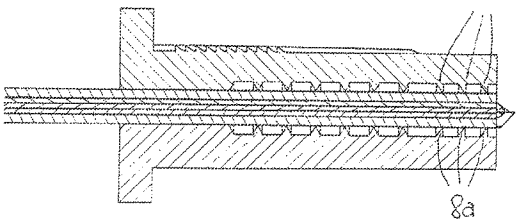
FIG. 42 is a longitudinal section view of another embodiment of a plug which differs slightly from the plug shown in FIG. 17, according to another embodiment of the invention.

FIGS. 42 and 43, in another embodiment, show that the pointed edges of the teeth 8*a* (all of which have been labelled in FIG. 42) can extend perpendicularly towards the central longitudinal axis, rather than towards the socket receiving end 5.

The teeth 8, 8*a* may or may not deflect when gripping or biting the wire 20. That is, the teeth 8, 8*a* may be flexible or rigid in differing circumstances depending on the nature of the wire—for example, whether insulated or not, and whether flexible or malleable or not. The teeth 8, 8*a* as illustrated can grip or bite into the exterior insulating coat or sheath of the wire 20.

Referring chiefly now to FIGS. 1 to 17, the sealing formation 9 has ridges extending as circumferential pointed ridges/teeth 9 around the inside face 3, and spaced apart from one another along the inside face 3 relative to the longitudinal axis (not all of the sealing formation ridges/teeth 9 have been labelled). The pointed ridges/teeth 9 contact an outer periphery of the wire 20.

The two piercers 11 are spikes that extend from the socket receiving end 5 (plug end wall 5) of the plug body 2.

The vent 10 is in the form of two V-shaped channels 10 that extend longitudinally along the outside face 4 of the plug body 2, at opposing sides of the plug body 2. Each channel 10 extends from the socket receiving end 5 to the enlarged head 6.

As seen in FIGS. 1-4, the plug body 2 comprises two substantially identical body halves 2 that are hinged together at the socket receiving end 5 by way of two live hinges/fold lines 13. FIGS. 1-11 show that the plug body 2 is configurable in a first wire-receiving configuration so that a wire 20 can be snugly seated within part of the passage 7 so that an end of the wire 20 sits flush with the plug end wall 5, and FIGS. 12-17 show that the plug body 2 is configurable in a second clamping configuration so that the plug body 2 can clamp to and retain the wire 20 within the passage 7 after the plug 1 has been received within a socket 30 (see FIGS. 21-25). The plug body 2 is in the form of a cylindrical sleeve/tube extending around the wire 20 when in the second clamping configuration. Clamping of the wire 20 is most clearly shown in FIGS. 12-17. Although the plug 2 can be manufactured in a form as shown in FIG. 1 and then manipulated into the form shown in FIGS. 5 to 8 and then manipulated further to clamp a wire 20 as shown in FIG. 12, it is to be understood that the plug 2 may be manufactured in a different form from that shown in FIG. 1.

The plug 1 as illustrated is of unitary construction and is made of moulded plastics material having a Shore D hardness of approximately 85+, or 100-120R Rockwell.

Referring now to FIGS. 18-26, there is shown in a socket 30 for receiving the plug assembly 23, according to embodiment of the present invention. The socket 30 includes an opening 31 extending axially within a main body 32 for receiving the socket receiving end 5 of the plug body 2. The main body 32 is in the form of a sleeve and has an outer face 33 and an inner face 34 that extends around the opening 31. The socket 30 has an end wall 35 that borders a blind end 36 of the opening 31.

The socket main body 32 and end wall 35 can be made of any suitable non-conductive material or materials such as plastics material, rubber, carbon fibre, insulated metal or ceramics material. The socket main wall and end wall are preferably made of plastics material, and may have a Shore D hardness of approximately 85+ or 100-120R Rockwell.

The socket 30 as illustrated in FIGS. 11 and 18-25 is for making a waterproof electrical connection. To that end, the socket 30 includes a conductive penetrator 37 (conductor) in the form of a conductive spike 37 and a rupturable membrane/bladder 38 containing a sealant 39 within the blind end 36 of the opening 31.

The conductive spike 37 has a sharpened end 40 (see FIGS. 20 and 25) extending within the opening 31 that is capable of penetrating the conductive filament 21 of the wire 20 (and outer insulating coating/sheath 22, if required). Another end of the conductive spike 37 extends through the end wall 35 in a sealed manner and has an enlarged head (electrical contact point) 41 that protrudes slightly from the end wall 35 (see FIGS. 20 and 25).

The rupturable membrane/bladder 38 containing the sealant 39 extends as an annulus about the conductive spike 37. In this embodiment the sealant 39 is a liquid chemical which, when exposed to air or alternatively moisture, cures/hardens. In use, as the plug body 2 is inserted into the socket opening 31, the two piercers 11 rupture the membrane 38, thereby releasing the liquid sealant 39 from the membrane/bladder 38. As the socket receiving end 5 of the plug 1 is moved toward the end wall 35, the conductive spike 37 penetrates the wire 20 and the sealant 39 and air are displaced from the blind end 36 of the opening 31 and flow into the wire 20 and passage 7, as well as between the outside face 4 of the plug body 2 and inner face 34 of the socket main body 32 and in particular through the vent channels 10. In this way, the sealant adheres to the plug body 2, wire 20 and socket main wall 32 and end wall 35, and renders the connection between the wire filament 21 and conductive spike 37 waterproof. Normally, due to the volume of sealant 39 present, the sealant 39 fills the vent channels 10 but does not overflow the socket main body 32.

Depending on the nature of the sealant, the socket 30 can contain two separate membranes/bladders each of which contains different sealant components which, once mixed, cure/harden (eg. multi-part adhesives). The membranes/bladders may be located within the blind end of the opening—each side of the conductive spike 37. In such an instance, the connection apparatus may have more than one piercer.

The sealant is preferably insoluble, non-conducting, corrosion resistant and adhesive. It is preferably a liquid, although it need not be free-flowing. The term includes all types of sealants usually used for electrical work, including adhesives, cements, pastes and other settable materials. Examples include silicone-based sealants, drying adhesives, contact adhesives, one-part adhesives and multi-part adhesives (polyester resin-polyurethane resin, polyols-polyurethane resin, and acrylic polymers-polyurethane resins). This list is by no means exhaustive.

Figure 44:
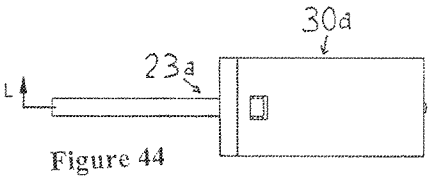
FIG. 44 is a top view of the plug and socket shown in FIG. 43, except that the plug assembly has been received within the socket to form a connection apparatus, according to an embodiment of the invention.
Figure 45:
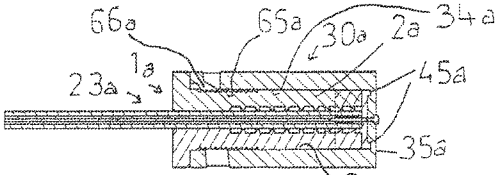
FIG. 45 is a section view of that shown in FIG. 44, taken through plane L-L.

The embodiment of FIGS. 43 to 45 shows that the plug 1*a* can have piercers 11*a* that are received within a circular recess 45*a* in an end wall 35*a* of a socket 30*a*.

Figure 46:
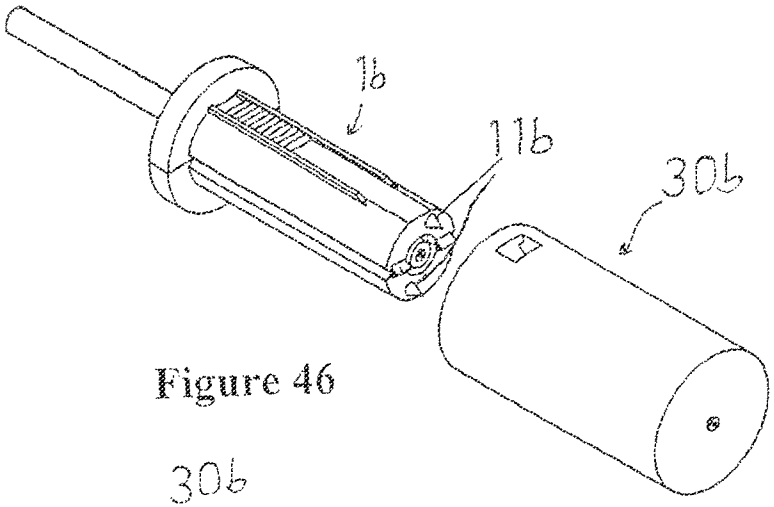
FIG. 46 is an isometric view of a plug and socket which differ slightly from those shown in FIG. 45, according to another embodiment of the invention.
Figure 47:
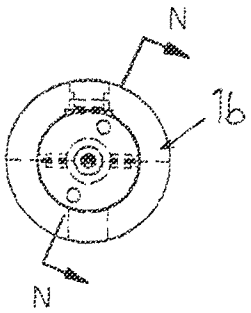
FIG. 47 is an end view of that shown in FIG. 46.
Figure 48:
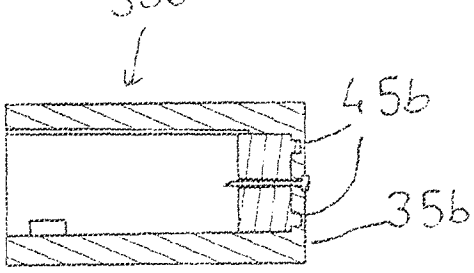
FIG. 48 is a section view of that shown in FIG. 47, taken through plane N-N.
Figure 48:
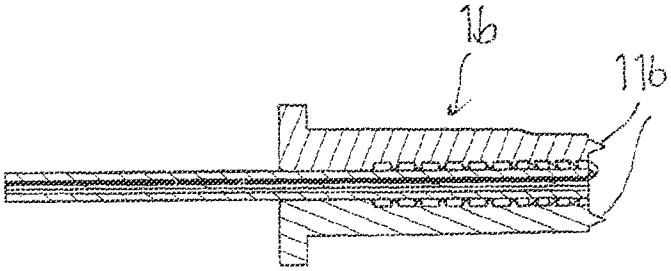

The embodiment of FIGS. 46 to 48 shows that the plug 1*b* can have a different arrangement of piercers 11*b* that are received with a circular recess 45*b* in an end wall 35*b* of a socket 30*b*.

Figure 49:
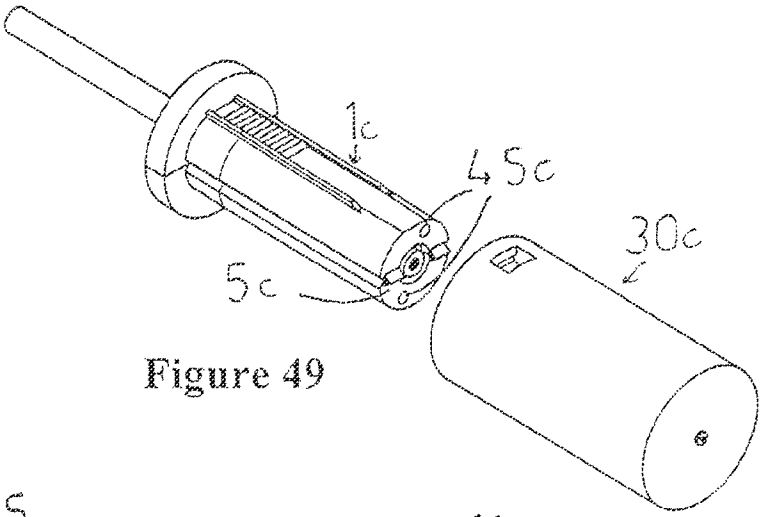
FIG. 49 is an isometric view of a plug and socket which differ slightly from those shown in FIG. 45, according to another embodiment of the invention.
Figure 51:
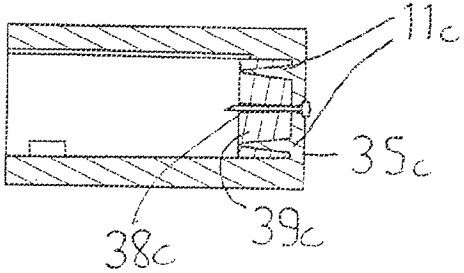
FIG. 51 is a section view of that shown in FIG. 50, taken through plane P-P.
Figure 51:
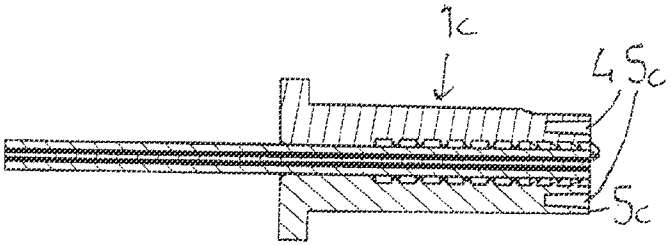
Figure 50:
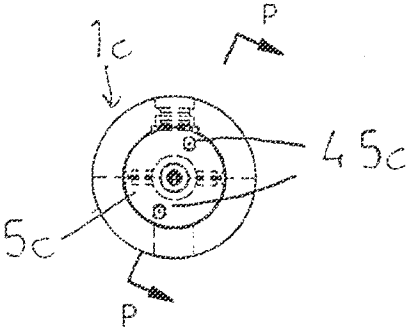
FIG. 50 is an end view of that shown in FIG. 49.

The embodiment of FIGS. 49 to 51 shows that piercers 11*c* can be provided by a socket 30*c* rather than a plug 1*c*. Two piercing spikes 11*c* extend from a socket end wall 35*c* within a rupturable membrane 38*c* containing sealant 39*c*. The piercers 11*c* are receivable within recesses 45*c* located within a socket receiving end 5*c* of the plug 1*c*.

As seen in FIGS. 9, 12, 13, 20, 21, 25 and 26, the connection apparatus 23 includes a guide for aligning the plug body 2 with the socket main body 32 and guiding it axially within the opening 31 in the socket 30. The guide is in the form of a key 50 and keyway 51 arrangement, whereby a key 50 comprising two parallel ridges extending longitudinally along the outside face 4 of the plug body 2 (best seen in FIG. 12) is receivable within a keyway 51 comprising a longitudinal passage extending as a groove within the inner face 34 of the socket main wall 32 (best seen in FIG. 9).

As seen in FIGS. 9, 12, 13, 20, 21, 25 and 26, the connection apparatus includes an engagement formation enabling the plug body 2 to be received within an opening 31 in the socket 30 and to be held or locked in place within the socket opening 31. The engagement formation as depicted includes the outside face 4 of the plug body 2 having teeth 55 (not all of which have been labelled) that engage teeth 56 located at the main body inner face 34 (see FIG. 26). The teeth 55, 56 are in the form of a pawl and ratchet arrangement whereby the teeth 56 of the pawl 56 engage the ratchet teeth 55 as the plug body 2 is inserted into the socket opening 31. The pawl 56 is hinged to the main body 32 of the socket 30 via hinge 57 (see FIGS. 25 and 26) and the teeth of the pawl 56 extend adjacent the inner face 34 of the main body 32 within the keyway passage 51 to thereby engage the teeth 55 that are present on the outside face 4 of the plug body 2—which teeth 55 are located between the key 50 ridges. As the plug body 2 is inserted into the socket opening 31, the teeth 55 on the plug body 2 lift the teeth 56 of the pawl out of engagement by way of its hinge 57. However, when the teeth 56 of the pawl engage the teeth 55 of the plug body 2, because the teeth 55, 56 extend directionally, the plug body 2 is unable to be removed from the socket 30 unless the pawl teeth 56 are manually disengaged from the teeth 55 of the plug body 2.

In the embodiment shown in FIGS. 43, 44 and 45, the connection apparatus 23*a* lacks a guide and has a different type of engagement formation enabling the plug body 2*a* to be received within an opening 31*a* in the socket 30*a* and to be held or locked in place within the socket opening 31*a*. The engagement formation as depicted includes the outside face 4*a* of the plug body 2*a* having circumferentially extending teeth/ridges 65*a* that engage teeth/ridges 66*b* located at the main body inner face 34*a*. The teeth 66*a* located at the main body inner face 34*a* are in the form of a hinged pawl 66*a*, essentially as described above.

In FIGS. 9, 18-20, 21-26, 43-48 and 49-51, the socket 30 contains a conductor 37 and can convert the plug assembly 23 into a type of electrical plug that can then be plugged into an external or internal socket of an electrical appliance, equipment or device, for example. An electrical appliance, equipment or device includes, but is not limited to, anything of an electrical or electronic nature, or anything used in the transfer or transmission of data. An electrical appliance, equipment or device includes a major appliance, microcontroller, power tool or small appliance, or a component part of an electrical distribution system such as an electric switchboard, distribution board, circuit breaker or disconnect, electricity meter or transformer. It is also possible that the plug assembly 23 could be plugged directly into an electrical appliance, equipment or device that contains key features of the socket 30.

Figure 25:
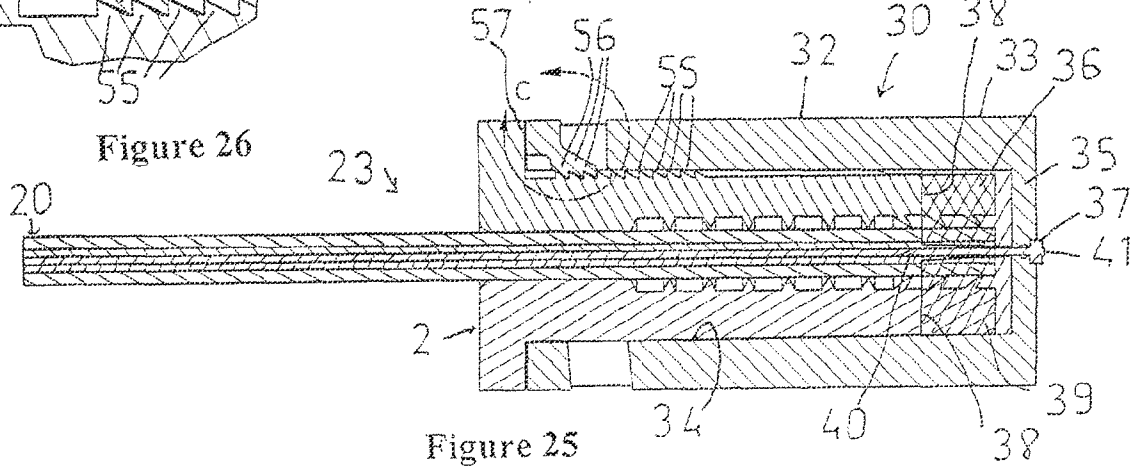
FIG. 25 is a section view of that shown in FIG. 21, taken through plane B-B.
Figure 27:
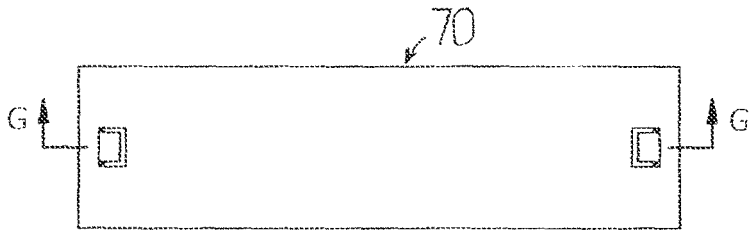
FIG. 27 is a top view of a dual socket, according to an embodiment of the present invention.
Figure 28:
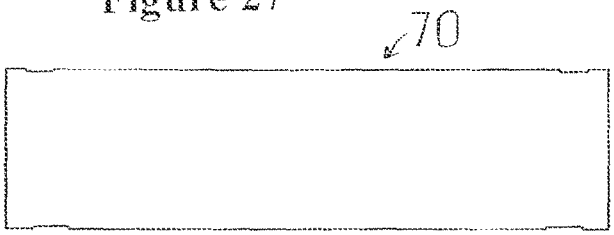
FIG. 28 is a front view of the socket shown in FIG. 27.
Figure 29:
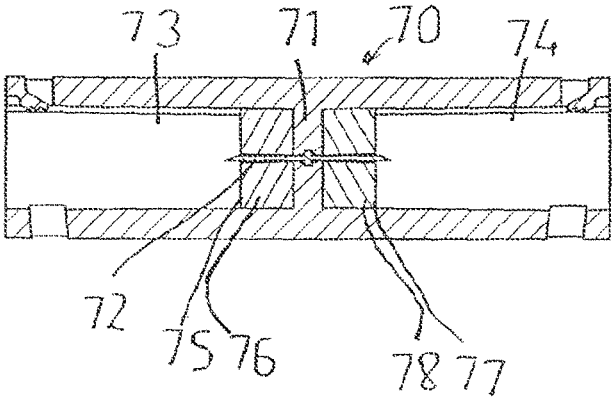
FIG. 29 is a section view of the socket shown in FIG. 27, taken through plane G-G.
Figure 30:
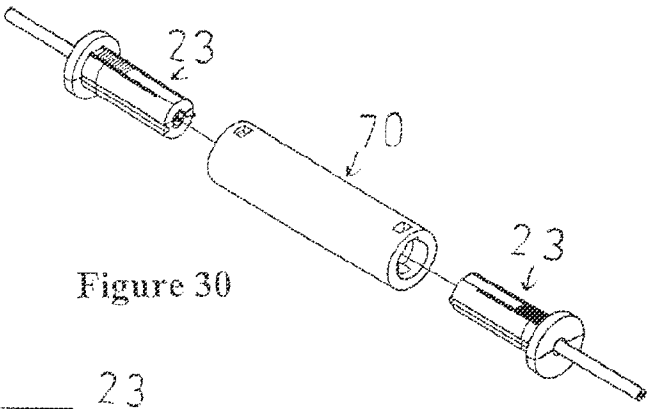
FIG. 30 is an exploded isometric view of a dual socket assembly receiving two plug assemblies as shown in FIG. 12, to form a connection apparatus.
Figure 35:
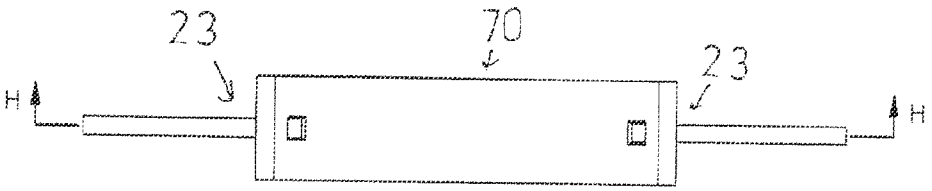
FIG. 35 is a top view of that shown in FIG. 31 except that both plug assemblies have been fully received within the sockets.
Figure 36:
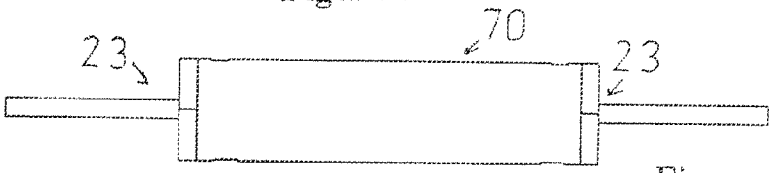
FIG. 36 is a front view of that shown in FIG. 35.

Referring now to FIGS. 38-41, there is shown the socket 30 of FIG. 25 but when connected to or part of an electrical appliance, equipment or device 68 and the electrical appliance, equipment or device 68 is generally depicted as a rectangle in broken lines. The conductive spike 37 can be soldered or otherwise electrically connected to circuitry of the appliance, equipment or device 68.

Figure 41:
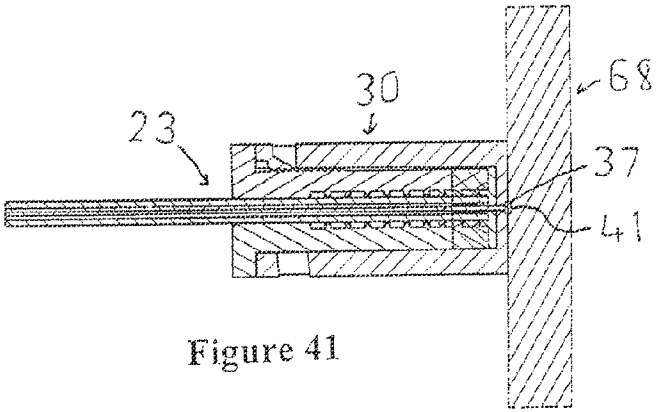
FIG. 41 is a section view of that shown in FIG. 39, taken through plane K-K.

Alternatively, the socket 30 itself can be plugged into a further external or internal electrical socket of an electrical appliance, equipment or device 68—in which case the socket 30 would become an electrical plug of sorts whereby conductive spike head 41 becomes the electrical contact point of the new plug (see FIG. 41).

Figure 20:
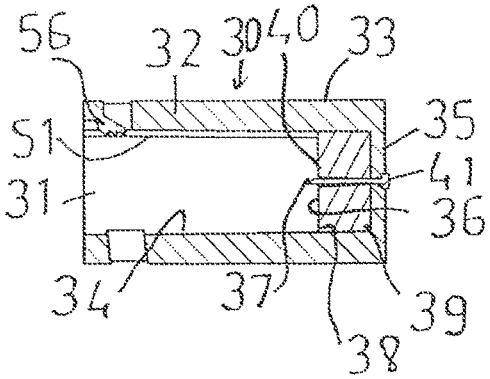
FIG. 20 is a section view of the socket shown in FIG. 18, taken through plane F-F.
Figure 21:
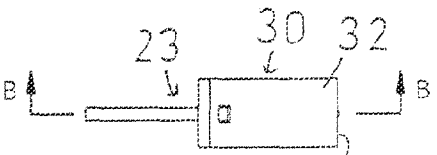
FIG. 21 is a top view of the plug assembly of FIG. 12 received within the socket of FIG. 18 to form a connection apparatus.
Figure 22:
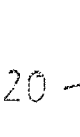
FIG. 22 is a left view of that shown in FIG. 21.
Figure 23:
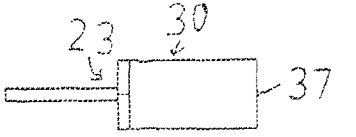
FIG. 23 is a front view of that shown in FIG. 21.
Figure 24:
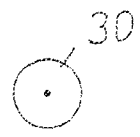
FIG. 24 is a right view of that shown in FIG. 21.
Figure 26:
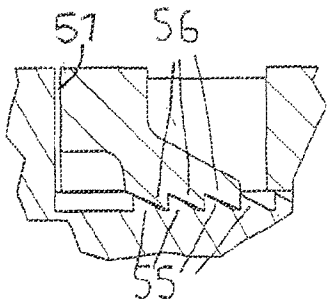
FIG. 26 is a detail view showing part of the connection apparatus of FIG. 25.

Referring now to FIGS. 27-37, there is shown the socket 30 of FIGS. 20 and 25 but configured as a double unit 70 (ie. a socket assembly). That is, a socket like the socket 30 of FIG. 20 or FIG. 25 is connected end wall to end wall—which in fact becomes a median wall 71—and a conductive penetrator spike/conductor 72 extends from one blind end of an opening 73 to the other 74. The double socket 70 can be used to electrically connect a wire 20 from a first plug assembly 23 to a wire 20 of a second plug assembly 23 in a waterproof manner. However, it is possible to omit the rupturable membranes 75, 77 and sealant 76, 78, in which case the connection may not be waterproof.

Figure 37:
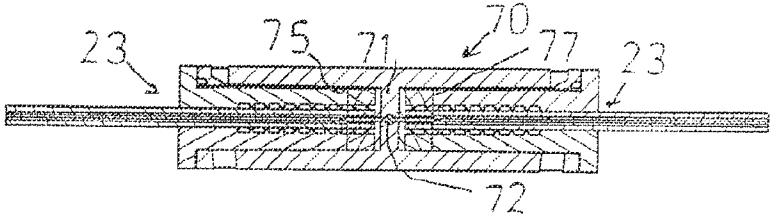
FIG. 37 is a section view of that shown in FIG. 35, taken through plane H-H.
Figure 34:
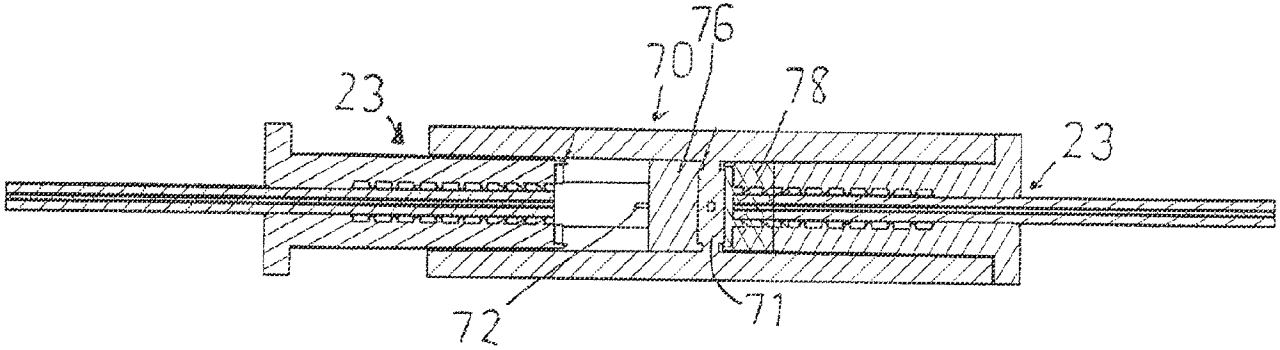
FIG. 34 is a section view of that shown in FIG. 32, taken through plane J-J.
Figure 31:
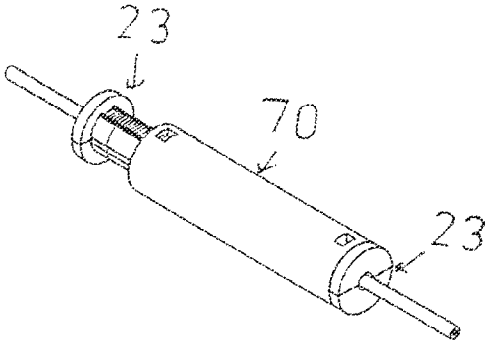
FIG. 31 is an isometric view of that shown in FIG. 30 except a first plug assembly has been fully received within a first socket and a second plug assembly is in the process of being received within a second socket, to form a connection apparatus.
Figure 33:
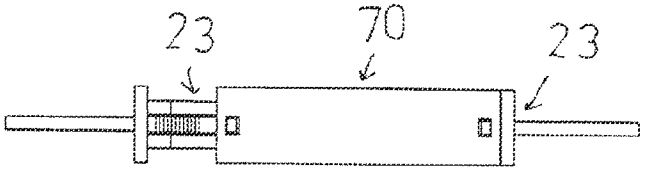
FIG. 33 is a top view of that shown in FIG. 31.
Figure 32:
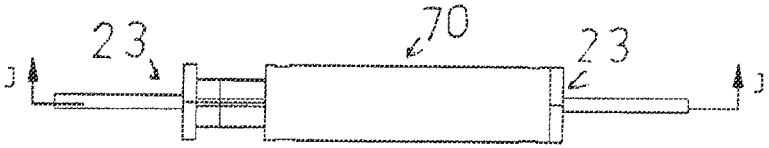
FIG. 32 is a front view of that shown in FIG. 31.
Figure 55A:
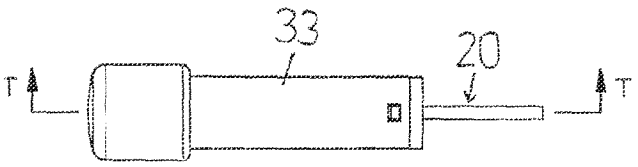
FIG. 55*a* is a top view of that shown in FIG. 54.
Figure 55B:
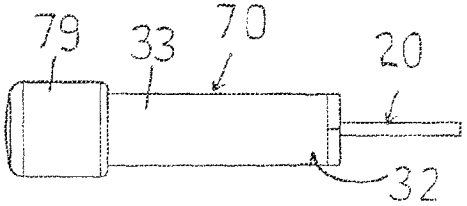
FIG. 55*b* is a side view of that shown in FIG. 54.
Figure 54:
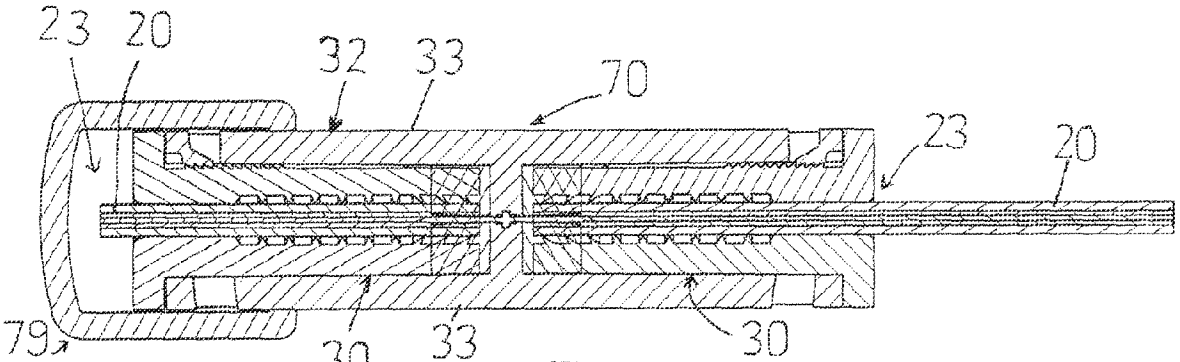
FIG. 54 is essentially the same as FIG. 37, except further showing a closure of the connection apparatus, according to an embodiment of the present invention.
Figure 56:
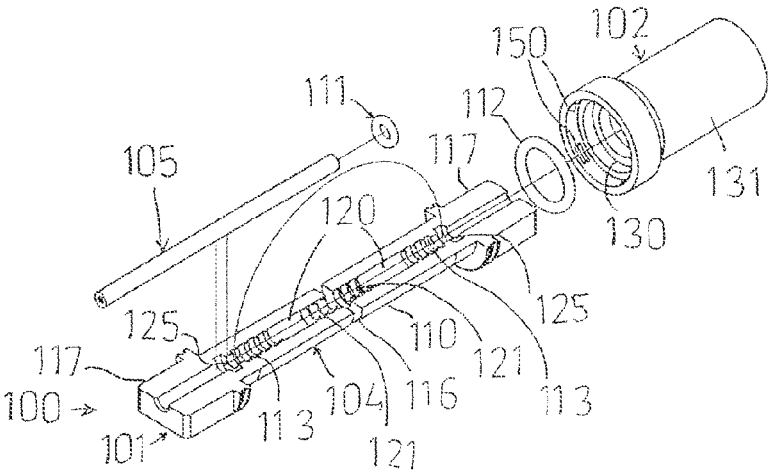
FIG. 56 is an exploded isometric view of a wire, plug and socket, together forming an electrical connection apparatus, according to an embodiment of the invention.
Figure 57:
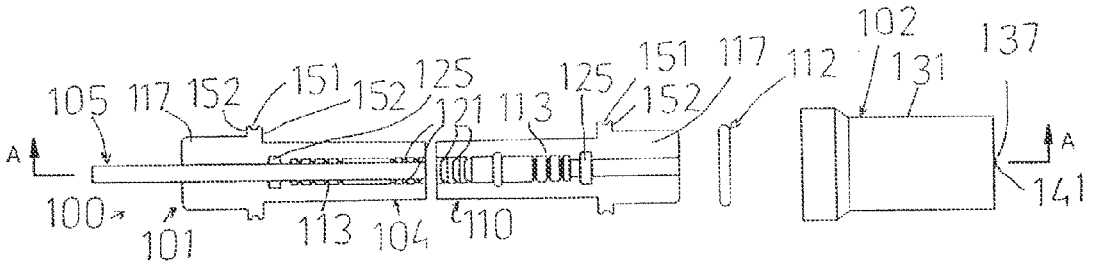
FIG. 57 is a top view of that shown in FIG. 56.
Figure 58:
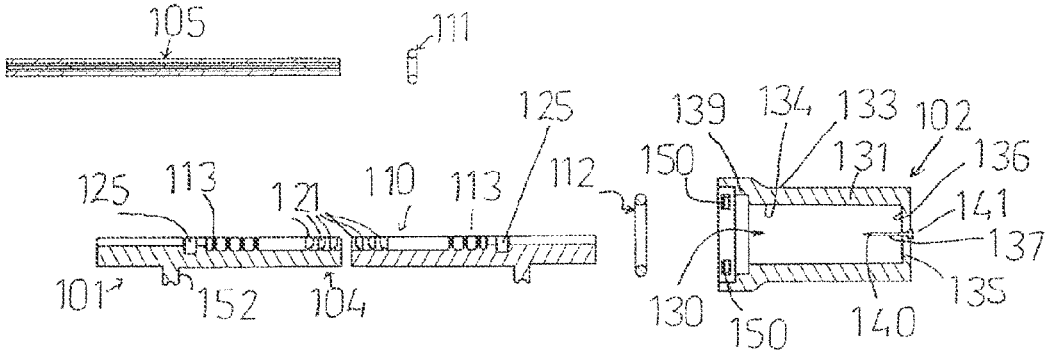
FIG. 58 is a longitudinal cross-sectional view taken through plane A-A of FIG. 57.
Figure 60:
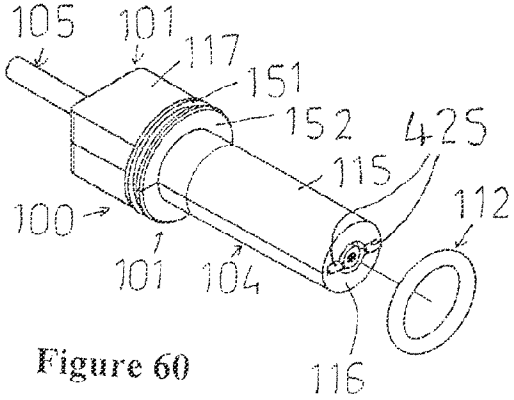
FIG. 60 shows a second stage of assembling an electrical connection apparatus.

FIGS. 54, 55*a* and 55*b* show the double socket 70 of FIG. 37 but further having a closure 79 for enclosing a wire 20. The closure 79 is in the form of a cap that extends over an end of the plug assembly 23 and friction fits to the outer face 33 of the main body 32 of the socket 30. The closure 79 is particularly useful for isolating a live wire/conductor, such as for a circuit breaker and can, of course, be used in a single socket arrangement.

Figure 52:
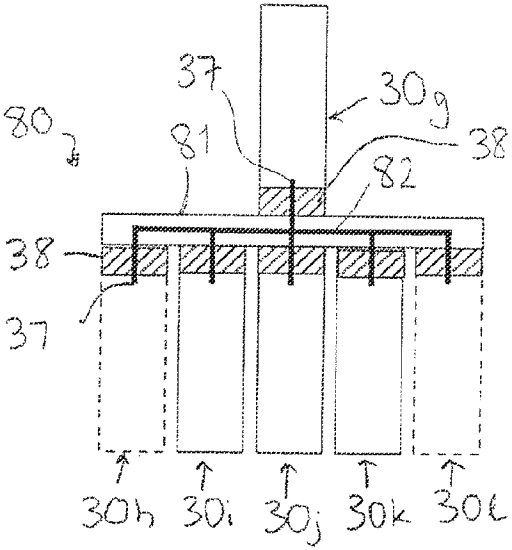
FIG. 52 is a detailed plan view of a socket assembly comprising a plurality of sockets like that shown in FIGS. 20 and 25 (but only shown in part), all being electrically connected together, according to an embodiment of the present invention.
Figure 38:
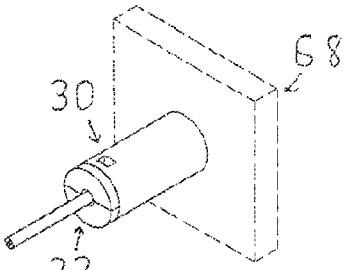
FIG. 38 is an isometric view of a socket that is part of an electrical appliance, equipment or device, according to another embodiment of the invention.

Referring now to FIG. 52, there is shown a detailed plan view of a socket assembly 80 comprising a plurality of sockets 30*g*, 30*h*, 30*i*, 30*j*, 30*k*, 301 essentially like the socket 30 shown in FIGS. 20 and 25 (but only shown in part), all being connected mechanically and electrically together. Each socket 30 includes a penetrator/conductor 37 and rupturable membrane or bladder 38. The assembly 80 comprises an interconnecting body 81 and an interconnecting conductor 82. In this way, the penetrator/conductor 37 of each socket 30 is electrically connected together. Each socket 30 can receive a plug like plug 2 or plug assembly like plug assembly 23. The sockets 30*h*, 301 are shown in broken lines as they represent any suitable number of sockets.

Figure 53:
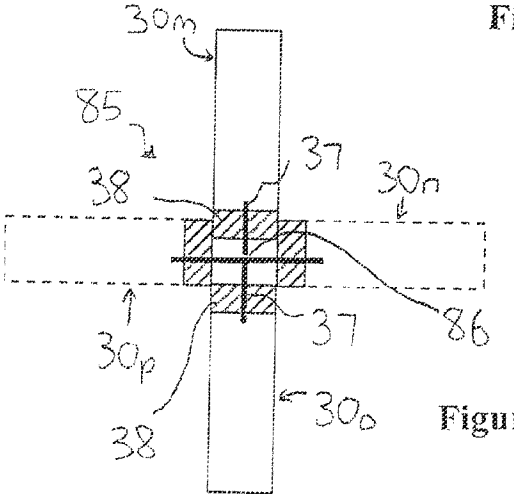
FIG. 53 is a detailed plan view of a socket assembly comprising a plurality of sockets like that shown in FIGS. 20 and 25 (but shown in part), all being electrically connected together, according to an embodiment of the present invention.
Figure 39:
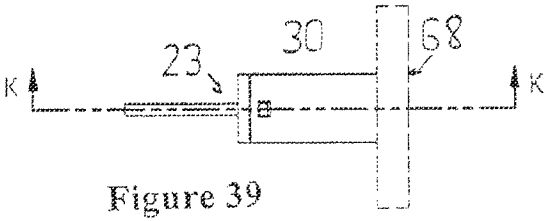
FIG. 39 is a top view of that shown in FIG. 38.
Figure 40:
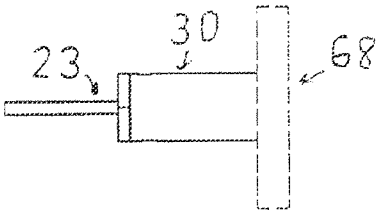
FIG. 40 is a side view of that shown in FIG. 38.

Referring now to FIG. 53, there is shown a detailed plan view of a socket assembly 85 comprising a plurality of sockets 30*m*, 30*n*, 30*o*, 30*p*, essentially like the socket 30 shown in FIGS. 20 and 25 (but only shown in part), all being connected mechanically and electrically together. Each socket 30 includes a penetrator/conductor 37 and rupturable membrane or bladder 38. The assembly 85 comprises interconnecting ends and an interconnecting conductor 86. In this way, the penetrator/conductor 37 of each socket 30 is electrically connected together. Each socket 30 can receive a plug like plug 2 or plug assembly like plug assembly 23. The sockets 30*n*, 30*p* are shown in broken lines as they represent any suitable number of sockets.

Advantages of the present invention as exemplified include:

1. Waterproof electrical connections between wires and/or an electrical appliance, equipment or device can be readily made, which can be particularly important in corrosive marine environments (where fires have been known to occur due to voltage leaks).
2. Waterproof electrical connections can be miniaturised by way of the plug and socket design.
3. The socket 30 itself can function as an electrical plug.
4. Components of the socket 30 can be incorporated within an electrical appliance, equipment or device.
5. No pre-stripping of the wire 20 is necessary because the conductive penetrator 37 can penetrate the sheath as well.
6. Possible contamination of the wire end by fingers is avoided once it has been clamped within the plug because the wire need not be trimmed nor twisted by the user.
7. The plug body can be of unitary construction, and thereby easy to manufacture by way of plastic moulding.
8. The plug/passage can be sized to accommodate wires of differing gauge.
9. Since the wire 20 is pre-clamped in the plug 2, the wire can easily be brought into electrical contact with a conductor 37, simply by inserting the plug 2 into the socket 30.

Referring now to FIGS. 56 to 66, there is shown a connection apparatus 100 including a plug 101 and socket 102. The plug 101 includes a plug body 104 and a sealing arrangement which in this embodiment renders the connection fluid-tight (waterproof). However, this need not be the case.

The plug 101 together with the wire 105 form a plug assembly.

Figure 66:
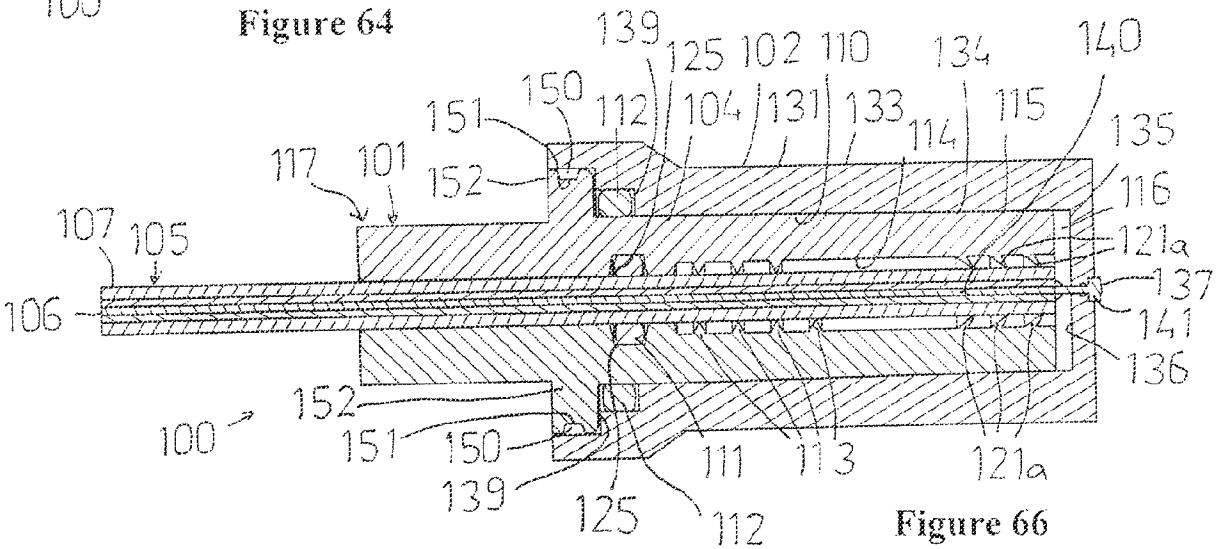
FIG. 66 is a longitudinal cross-sectional view taken through plane B-B of FIG. 62.

The wire 105 in this example has a conductive filament interior 106 and an insulating sheathed exterior 107, as best seen in FIG. 66.

As seen in FIGS. 56 to 60, the plug 101 includes a plug body 110 and a sealing arrangement that includes first 111 and second O-ring sealing members 112 and an optional sealing formation 113.

The plug body 110 has an inside face 114, an outside face 115, a socket receiving end 116 (plug end wall 116) and an enlarged flanged gripping head 117 (for pliers) at an opposing end 117. The plug 101 includes a passage 120 extending axially through the plug body 110, including the plug end wall 116 and head 117, for snugly receiving a wire 105, a gripping formation 121 extending inwardly from the inside face 114 for gripping the wire 105 when located within the passage 120, a groove 125 for containing the first O-ring 111, and the second O-ring 112 extending around the plug body 110, and the optional sealing formation 113 extending around the inside face 114 of the plug body 110 to further seal against fluid (such as air) from flowing between an outer periphery of the wire 105 and the inside face 114.

The passage 120 extends centrally along a longitudinal axis of the plug body 110, completely through the plug body 110, including the plug end wall/socket receiving end 116.

Alternatively, an end of the passage 120 at the socket receiving end 116 could be blind or substantially blind, so as to completely or substantially isolate and insulate an end of the wire 105 for a non-electrical connection with the socket 102. If blind, the socket 102 can simply help isolate an end of the wire 105 from electrical contact or the elements, such as rain or moisture. Alternatively, the socket 102 could be used as a means of labelling/identifying the wire/nature of the wire/intended purpose for the wire 105.

The diameter of the passage 120 will vary in accordance with the gauge of the wire, such that the fit is snug.

The gripping formation 121 has tapered teeth 121*a* (barbs) extending as circumferential pointed ridges around the inside face 114, and spaced apart from one another along the inside face 114 relative to the longitudinal axis (not all of the teeth 121*a* have been labelled). Sharp edges of the teeth 121*a* are pointed towards the socket receiving end 116 so as to prevent or minimise the risk of the wire 105 being pulled out of the passage 120 in an axial direction.

The teeth 121*a* may or may not deflect when gripping or biting the wire 105. That is, the teeth 121*a* may be flexible or rigid in differing circumstances depending on the nature of the wire—for example, whether insulated or not, and whether flexible or malleable or not. The teeth 121*a* as illustrated can grip or bite into the exterior insulating coat or sheath 107 of the wire 105 (as described for earlier embodiments).

The sealing formation 113, which is optional, has ridges extending as circumferential pointed ridges/teeth around the inside face 114, and spaced apart from one another along the inside face 114 relative to the longitudinal axis (the sealing formation ridges/teeth have not been labelled). The pointed ridges/teeth contact an outer periphery of the wire 105.

Figure 59:
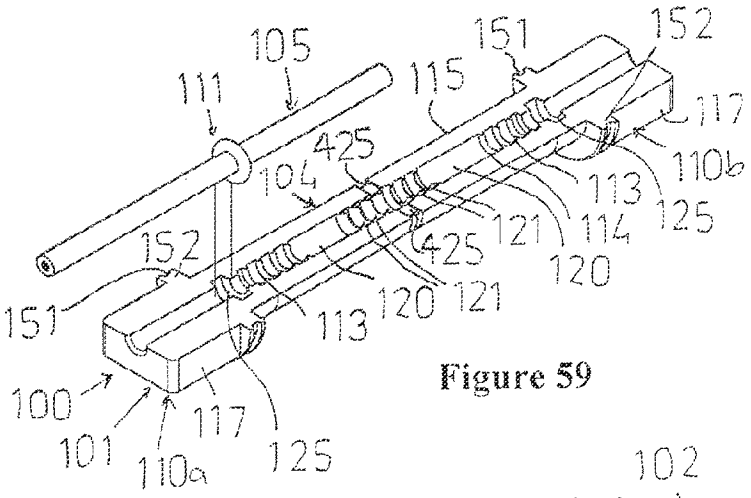
FIG. 59 shows a first stage of assembling an electrical connection apparatus using the components shown in FIG. 56.
Figure 61:
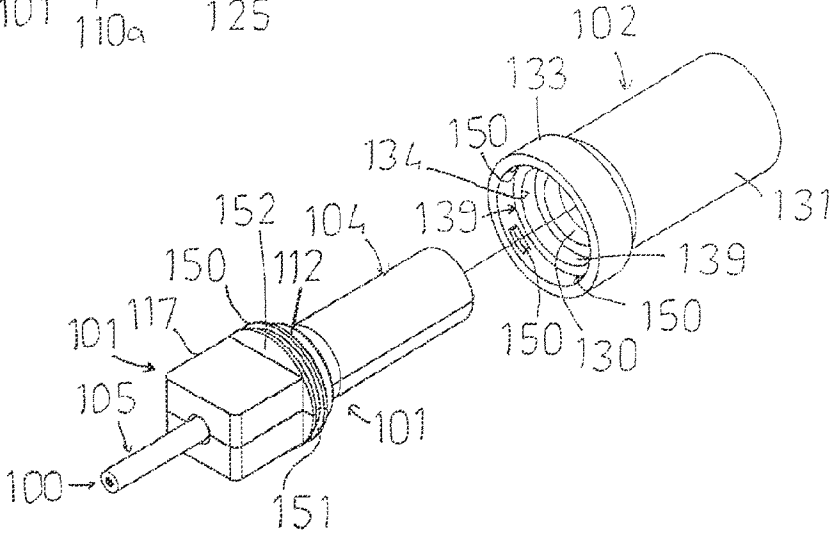
FIG. 61 shows a third stage of assembling an electrical connection apparatus.
Figure 65:
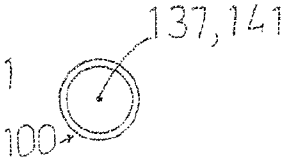
FIG. 65 is a right view of the apparatus shown in FIG. 62.
Figure 62:
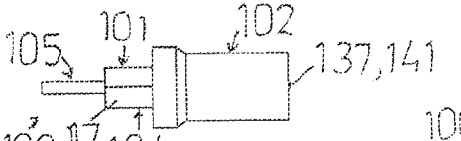
FIG. 62 is a top view showing an assembled electrical connection apparatus.
Figure 63:
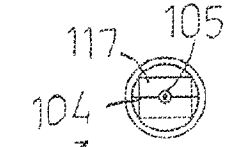
FIG. 63 is a left view of the apparatus shown in FIG. 62.
Figure 64:
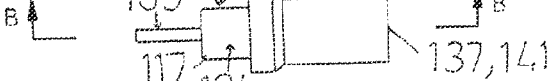
FIG. 64 is a front view of the apparatus shown in FIG. 62.

As seen in FIG. 59, the plug body 110 comprises two substantially identical body halves 110*a*, 110*b* that are hinged together at the socket receiving end 116 by way of two live hinges/fold lines 425 (shown in FIG. 59). The plug body 110 is configurable in a first wire-receiving configuration so that a wire 105 can be snugly seated within part of the passage 120 so that an end of the wire 105 sits flush with the plug end wall 116. The plug body 110 is configurable in a second clamping configuration so that the plug body 110 can clamp to and retain the wire 105 within the passage 120 after the plug 100 has been received within a socket 102. The plug body 110 is in the form of a cylindrical sleeve/tube extending around the wire 105 when in the second clamping configuration. Clamping of the wire 105 is most clearly shown in FIGS. 62 to 66. Although the plug 100 can be manufactured in a form as shown in FIG. 59 and then manipulated into the form shown in FIG. 60, it is to be understood that the plug 100 may be manufactured in a different form from that shown in FIG. 59.

The plug 100 as illustrated is of unitary construction and is made of moulded plastics material having a Shore D hardness of approximately 85+, or 100-120R Rockwell.

Referring now to FIGS. 56-58 and 61-66, there is shown in a socket 102 for receiving the plug assembly, according to embodiment of the present invention. The socket 102 includes an opening 130 extending axially within a main body 131 for receiving the socket receiving end 116 of the plug body 110. The main body 131 is in the form of a sleeve and has an outer 133 and an inner face 134 that extends around the opening 130. The socket 102 has an end wall 135 that borders a blind end 136 of the opening 130. The other end of the socket 102 is flared and includes an internal stepped shoulder/cavity 139.

The socket main body 131 and end wall 135 can be made of any suitable non-conductive material or materials such as plastics material, rubber, carbon fibre, insulated metal or ceramics material. The socket main wall and end wall are preferably made of plastics material, and may have a Shore D hardness of approximately 85+ or 100-120R Rockwell.

The socket 102 as illustrated is for making a waterproof electrical connection. To that end, the socket 102 includes a conductive penetrator 137 (conductor) in the form of a conductive spike 137.

The conductive spike 137 has a sharpened end 140 (see FIG. 58) extending within the opening 130 that is capable of penetrating the conductive filament 106 of the wire 105 (and outer insulating coating/sheath 107, if required). Another end of the conductive spike 137 extends through the end wall 135 in a sealed manner and has an enlarged head (electrical contact point) 141 that protrudes slightly from the end wall 135.

The connection apparatus 100 includes an engagement formation enabling the plug body 110 to be received within an opening 130 in the socket 102 and to be held or locked in place within the socket opening 130. The engagement formation as depicted includes the inner face 134 having circumferentially spaced locking flanges/tabs 150 (not all of which have been labelled) that engage a groove 151 in the flange 152 of the gripping head 117 of the plug body 110.

In use, the first sealing member 111 is threaded onto the wire 105, and the wire 105 is placed within the passage 120 such that an end of the wire 105 is situated at end 116 and the first sealing member 111 locates within groove 125, as seen in FIG. 59. The plug body 110 is configured such that the two plug body halves 110*a*, 110*b* are brought together to clamp the wire 105. The second sealing member 112 is then threaded onto the plug body 110 and, using a pair of pliers that grip head 117, the plug 100 is moved into the socket opening 130. As the socket receiving end 116 of the plug 100 is moved toward the end wall 135 of the socket 102, the conductive spike 137 penetrates the wire 105 and the groove 151 in the flange 152 and tabs 150 extending from the socket main wall 131 engage and lock together. The second sealing member 112 seats within shoulder/cavity 139. In this way, the plug body 2 and electrical connection are rendered fluid-tight.

It is to be appreciated that the plug 110 can be used with the socket types as illustrated in the earlier figures.

Referring now to FIGS. 67 to 88, there is shown a connection apparatus 200 including a plug 201 and socket 202. The plug 201 includes a plug body 204 and a plug adapter 205 which in this embodiment renders the connection fluid-tight (waterproof). However, this need not be the case. The plug 201 together with a wire 206 form a plug assembly.

As seen in FIGS. 67 to 71, 82 and 88, the plug 204 includes a plug body 210 having an inside face 213, an outside face 214, a plug adapter receiving end 215 and an enlarged head (flange) 216 at an opposing end. The plug 201 includes a passage 207 extending axially through the plug body 210 including the plug adapter receiving end 215, for snugly receiving a wire 206, a gripping formation 218 extending inwardly from the inside face 213 for gripping the wire 206 when located within the passage 207, and an optional sealing formation 209 extending around the inside face 213 of the plug body 210 to seal against fluid (such as air or moisture) from passing between an outer periphery of the wire 206 and the inside face 213.

Alternatively, an end of the passage 207 at the enlarged end 216 could be blind or substantially blind, so as to completely or substantially isolate and insulate an end of the wire 206 for a non-electrical connection with the socket 202. If blind, the socket 202 can simply help isolate an end of the wire 206 from electrical contact or the elements, such as rain or moisture. Alternatively, the socket 202 could be used as a means of labelling/identifying the wire/nature of the wire/intended purpose for the wire.

The diameter of the passage 207 will vary in accordance with the gauge of the wire, 206 such that the fit is snug.

The plug body 210 narrows in an axial direction from the enlarged end 216 to the adapter receiving end 215.

The gripping formation 218 has tapered teeth 218*a* (barbs) extending as circumferential pointed ridges around the inside face 213, and spaced apart from one another along the inside face 213 relative to the longitudinal axis (not all of the teeth 218*a* have been labelled). Sharp edges of the teeth 218*a* are pointed towards the enlarged end 216 so as to prevent or minimise the risk of the wire 206 being pulled out of the passage 207 in an axial direction.

The teeth 218*a* may or may not deflect when gripping or biting the wire 206. That is, the teeth 218*a* may be flexible or rigid in differing circumstances depending on the nature of the wire—for example, whether insulated or not, and whether flexible or malleable or not. The teeth 218*a* as illustrated can grip or bite into the exterior insulating coat or sheath of the wire 206.

The sealing formation 209 has ridges extending as circumferential pointed ridges/teeth 209*a* around the inside face 213, and spaced apart from one another along the inside face 213 relative to the longitudinal axis (not all of the sealing formation ridges/teeth 209*a* have been labelled). The pointed ridges/teeth 209*a* contact an outer periphery of the wire 206.

Figure 67:
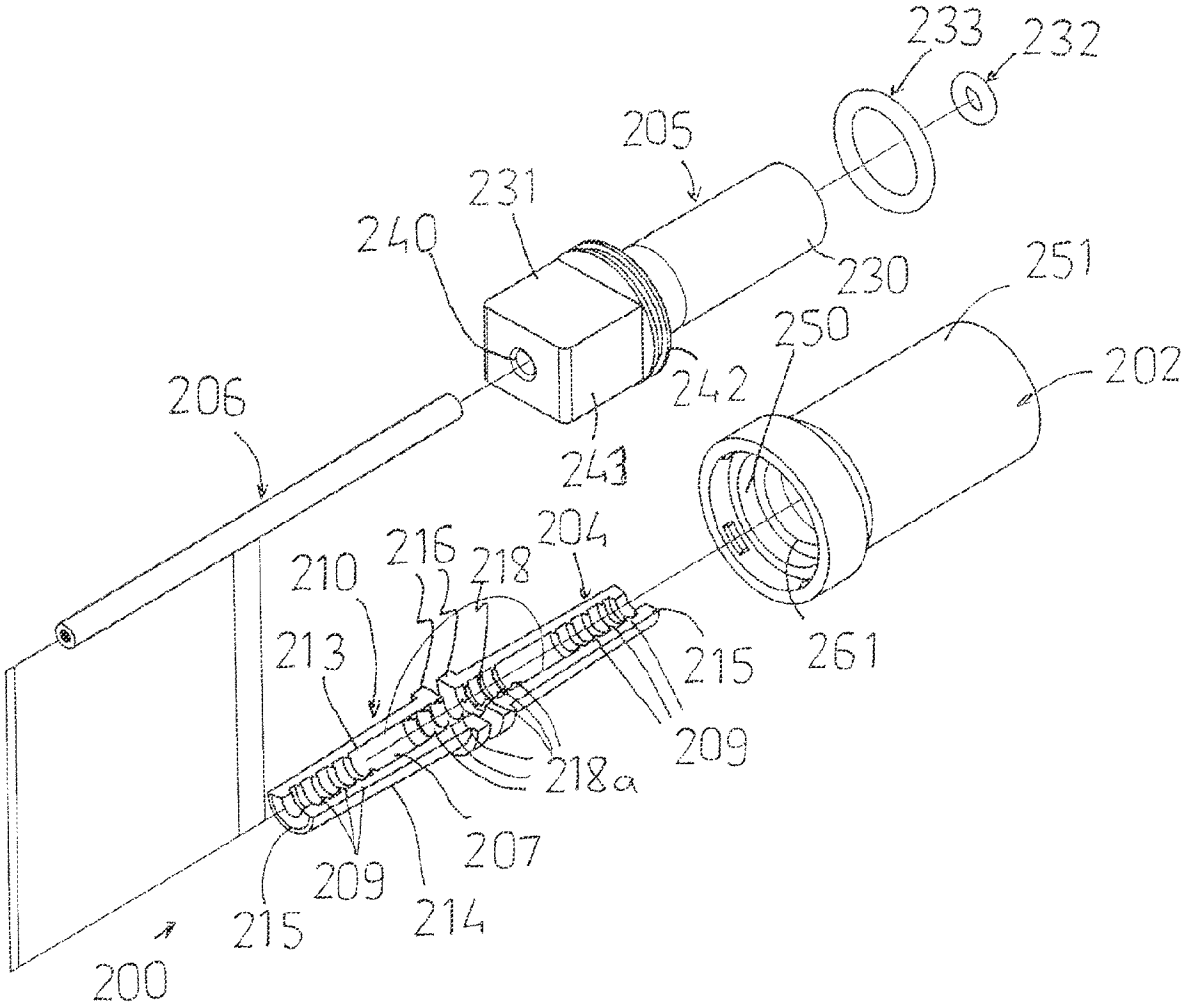
FIG. 67 is an exploded isometric view of a wire, plug and socket together forming an electrical connection apparatus, according to an embodiment of the invention.
Figure 68:
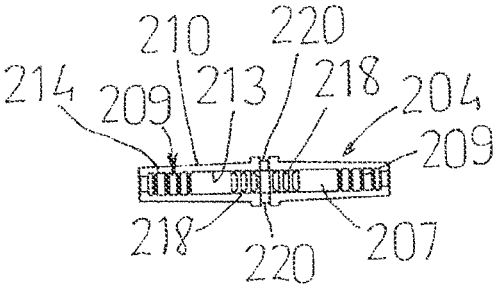
FIG. 68 is a top view of the plug shown in FIG. 67.
Figure 72:
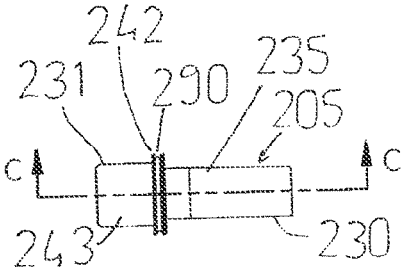
FIG. 72 is a top view of the plug adapter shown in FIG. 67.
Figure 69:
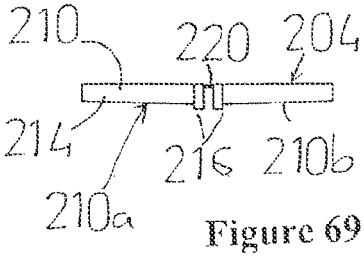
FIG. 69 is a front view of the plug shown in FIG. 68.
Figure 73:
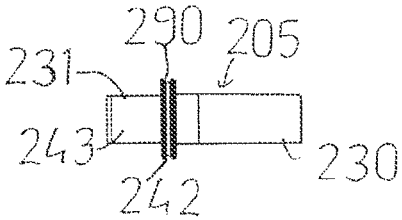
FIG. 73 is a front view of the adapter shown in FIG. 67.
Figure 70:
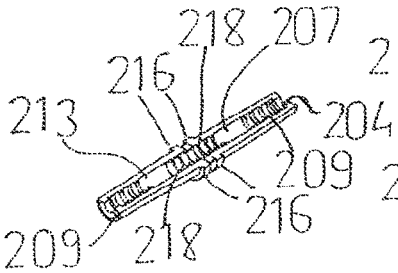
FIG. 70 is an isometric view of the plug shown in FIG. 68.
Figure 74:
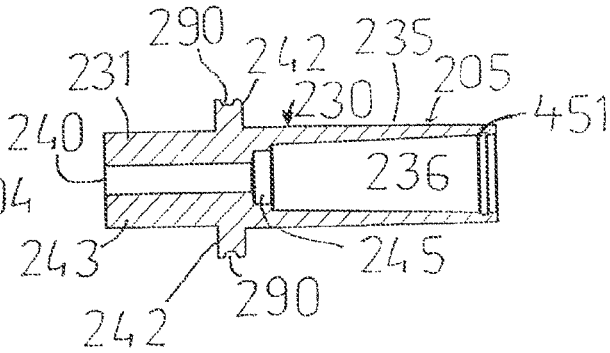
FIG. 74 is a longitudinal cross-sectional view of the adapter shown in FIG. 72, taken through plane C-C.
Figure 76:
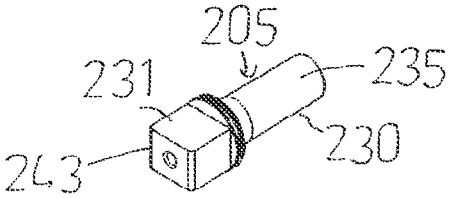
FIG. 76 is another isometric view of the adapter shown in FIG. 67.
Figure 78:
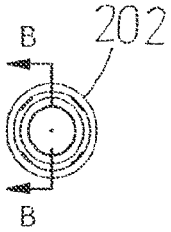
FIG. 78 is a left view of the socket shown in FIG. 67.
Figure 77:
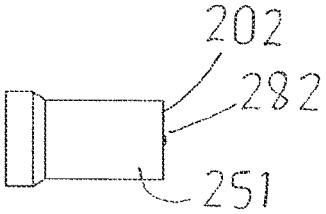
FIG. 77 is a front view of the socket shown in FIG. 67.
Figure 88:
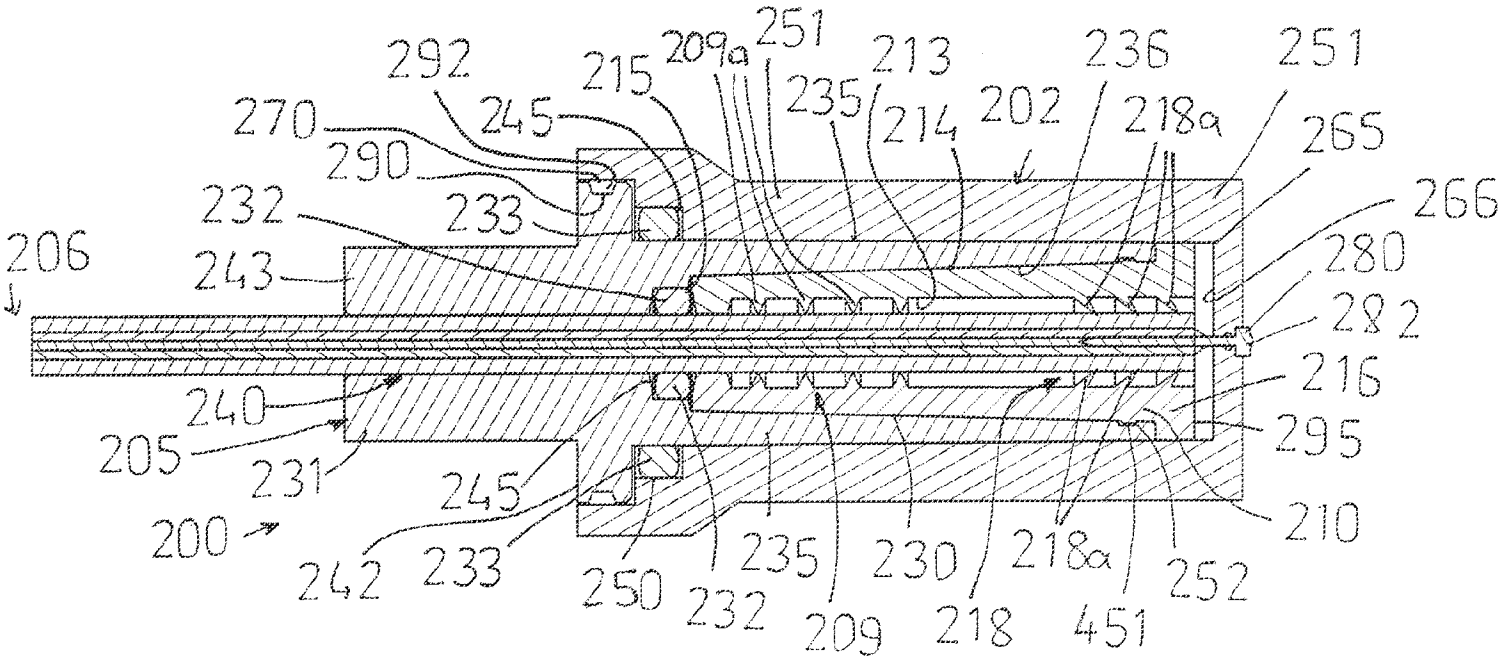
FIG. 88 is a longitudinal cross-sectional view of the electrical connection apparatus of FIG. 84, taken through plane A-A.

As seen in FIGS. 68 to 71, the plug body 210 comprises two substantially identical body halves 210*a*, 210*b* that are hinged together at the enlarged end 216 by way of two live hinges/fold lines 220. FIG. 67 (note:—does not illustrate the hinges) shows that the plug body 210 is configurable in a first wire-receiving configuration so that a wire 206 can be snugly seated within the passage 207 so that an end of the wire 206 sits flush with the enlarged end 216, and FIG. 88 shows that the plug body 210 is configurable in a second clamping configuration so that the plug body 210 can clamp to and retain the wire 206 within the passage 207 after the plug 201 has been received within a plug adapter 205. The plug body 210 is in the form of a cylindrical sleeve/tube extending around the wire 206 when in the second clamping configuration and narrows in diameter in an axial direction from the enlarged head 216 to the plug adapter receiving end 215. Clamping of the wire 206 is most clearly shown in FIG. 88. Although the plug 201 can be manufactured in a form as shown in FIG. 68 and then manipulated into the form shown in FIG. 71, it is to be understood that the plug 201 may be manufactured in a different form from that shown in FIG. 1.

The plug body 210 as illustrated is of unitary construction and is made of moulded plastics material having a Shore D hardness of approximately 85+, or 100-120R Rockwell.

As seen in FIGS. 72 to 76, the plug adapter 205 includes a barrel portion 230, a wire-receiving portion 231 and a sealing arrangement comprising first 232 and second 233 sealing members.

The barrel portion 230 includes a barrel wall 235 and an open-ended chamber 236. The chamber 236 narrows in an axial direction from the enlarged end 216 of the plug body 210 to the wire-receiving portion 231.

The wire-receiving portion 231 includes a wire-receiving passage 240 for receiving a wire 206. The wire-receiving portion 231 includes an enlarged end, comprising a circumferentially extending flange 242 and a cuboid body 243 enabling gripping by fingers or a pair of pliers. The wire-receiving passage 240 can be used to determine whether a wire is of an appropriate gauge/diameter.

As seen in FIG. 88, the first sealing member 232 is an O-ring that extends around the wire 206 within a cavity 245 of the plug adapter 205 adjacent the plug adapter engaging end 215 between the chamber 236 and the wire-receiving passage 240, for preventing fluid movement from the wire-receiving passage 240 to the plug body 210.

The second sealing member 233 is an O-ring that extends around the barrel wall 235, between the barrel wall 235 and socket 202, for preventing the entry of fluid into the socket 202. The second sealing member 233 extends around the barrel wall 235 adjacent the flange 242 of the wire-receiving portion 231, and is locatable within a cavity 250 of a socket main body 251.

The plug 201 also includes an engagement formation for holding the plug body 210 within the chamber 236. The engagement formation includes a groove 451 in the barrel wall 235 (best seen in FIGS. 74 and 88) that receives circumferential flanges/locking tabs 452 of the plug body 210 (best seen in FIGS. 71 and 88).

Referring now to FIGS. 67, 77 to 80, and 83 to 88, there is shown a socket 202 for receiving the plug assembly. The socket 202 includes an opening 261 extending axially within a main body 251 for receiving the plug 201. The main body 251 is in the form of a sleeve and has an outer face 263 and an inner face 264 that extends around the opening 261 (see FIG. 79). The socket 202 has an end wall 265 that borders a blind end 266 of the opening 261.

Figure 79:
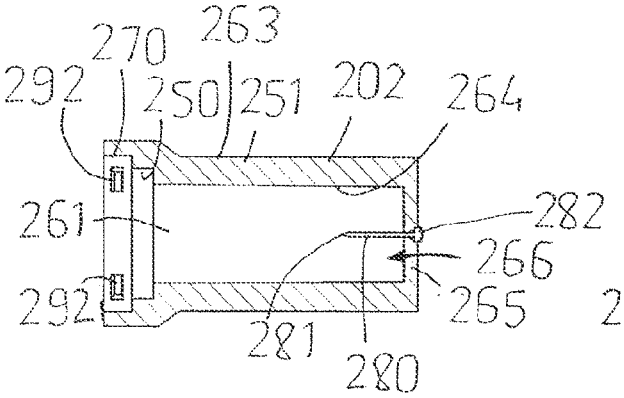
FIG. 79 is a longitudinal cross-sectional view of the socket shown in FIG. 78, taken through plane B-B.
Figure 80:
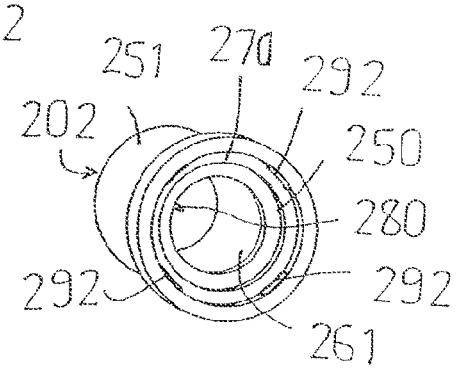
FIG. 80 is a perspective view of the socket shown in FIG. 67.
Figure 71:
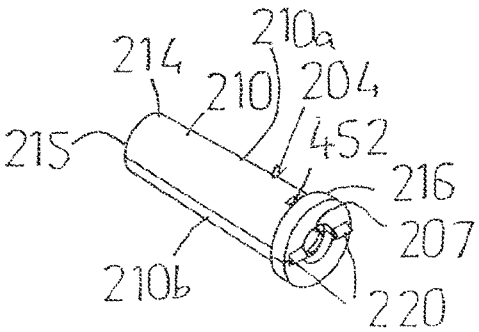
FIG. 71 is an isometric view of the plug shown in FIG. 68, but configured to grip a wire.
Figure 75:
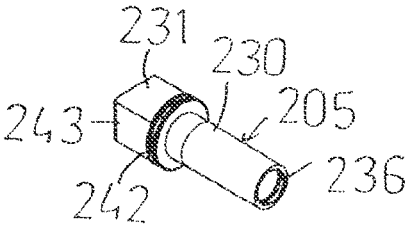
FIG. 75 is an isometric view of the adapter shown in FIG. 67.

An end of the socket main body 251 is flared, providing a stepped interior and adjacent cavities 250, 270 for receiving the second O-ring 233 and flange 242 of the wire-receiving portion 231. This is best seen in FIGS. 79 and 88.

The socket main body 251 and end wall 265 can be made of any suitable non-conductive material or materials such as plastics material, rubber, carbon fibre, insulated metal or ceramics material. The socket main body 251 and end wall 265 are preferably made of plastics material, and may have a Shore D hardness of approximately 85+ or 100-120R Rockwell.

The socket 202 as illustrated is for making a waterproof electrical connection. To that end, the socket 202 includes a conductive penetrator 280 (conductor) in the form of a conductive spike 280. The conductive spike 280 has a sharpened end 281 (see FIG. 79) extending within the opening 261 that is capable of penetrating the conductive filament of the wire 206 (and outer insulating coating/sheath, if required). Another end of the conductive spike 282 extends through the end wall 265 in a sealed manner and has an enlarged head (electrical contact point) 282 that protrudes slightly from the end wall 265 (see FIGS. 79 and 88).

The connection apparatus includes an engagement formation for holding the plug 201 within the socket 202. The engagement formation includes a groove 290 that extends along the flange 242 of the wire-receiving portion 231 (best seen in FIGS. 74 and 88) that receives circumferentially spaced flanges/locking tabs 292 that extend from the socket main body 251 (best seen in FIGS. 67, 79, 80 and 88).

Figure 81:
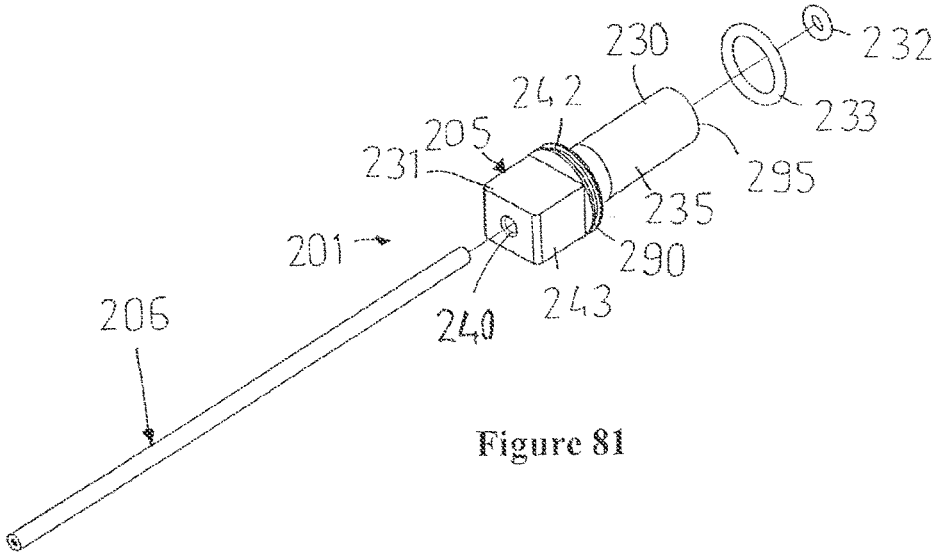
FIG. 81 shows a first stage of assembling an electrical connection apparatus using the components shown in FIG. 67.
Figure 82:
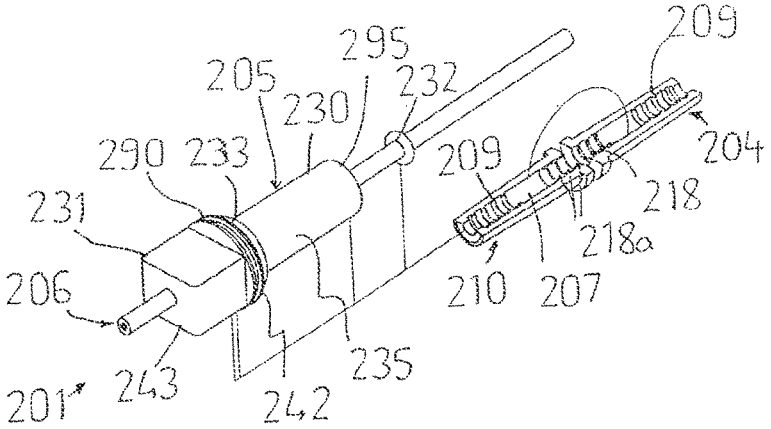
FIG. 82 shows a second stage of assembling an electrical connection apparatus.
Figure 83:
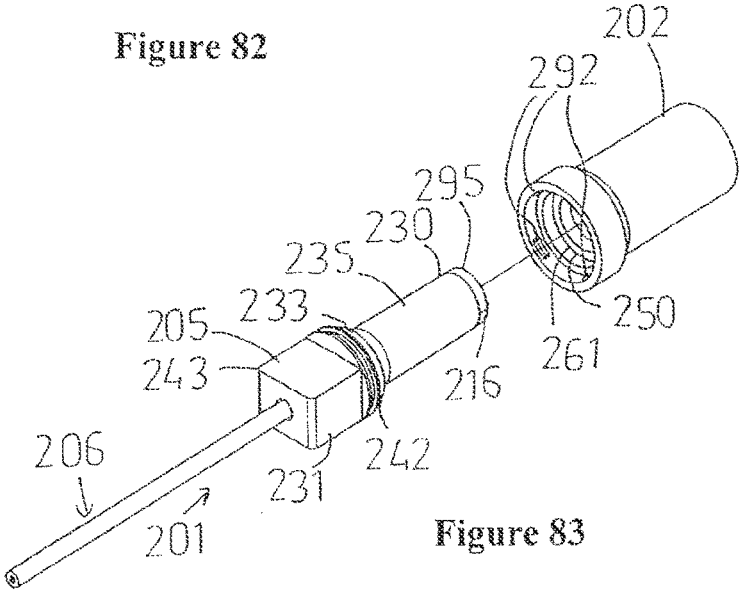
FIG. 83 shows a third stage of assembling an electrical connection apparatus.
Figure 84:
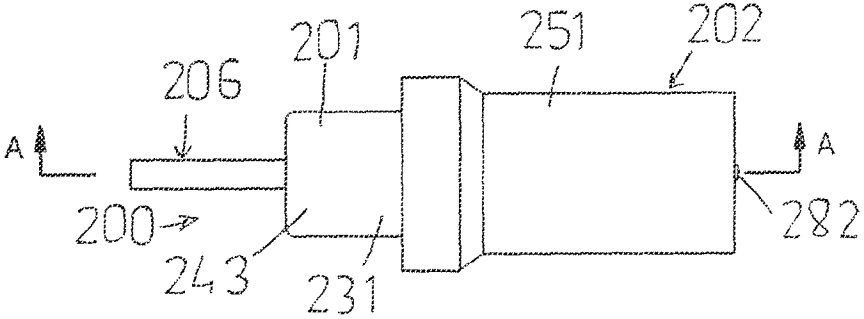
FIG. 84 is a top view showing an assembled electrical connection apparatus.
Figure 87:
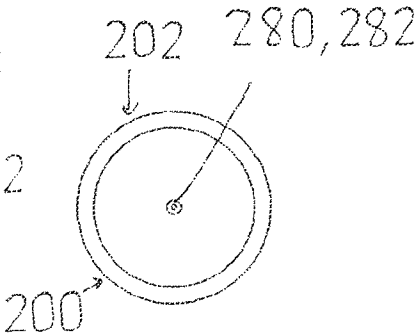
FIG. 87 is the right view of that shown in FIG. 84.
Figure 85:
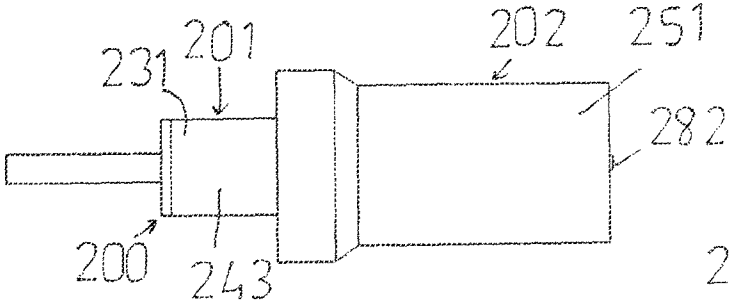
FIG. 85 is a front view of that shown in FIG. 84.
Figure 86:
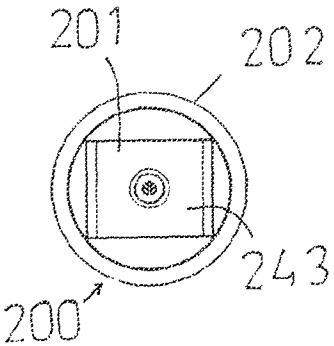
FIG. 86 is a left view of that shown in FIG. 84.

In use, a wire 206 is threaded through the wire-receiving passage 240 of the plug adapter 205, as seen in FIG. 81. The wire-receiving passage 240 can be used as a check that the wire is of an appropriate diameter. As seen in FIG. 82, the wire 206 is threaded through the second 233 and first 232 sealing members, and the wire 206 is then placed within the plug body 210 such that the first sealing member 232 locates adjacent the plug adapter receiving end 215. The plug body 210 is then configured such that the two plug body halves 210*a*, 210*b* are brought together to clamp the wire 206. The plug body 210 is then slid into the chamber 236 such that the adapter receiving end 215 abuts a blind end of the chamber 236, and the first sealing member 232 is trapped between the adapter receiving end 215 and the wire-receiving portion 231. The enlarged end 216 of the plug body 210 abuts an end of the barrel wall 235. As the plug body 210 is slid into the chamber 236, the engagement formation 251, 252 locks the plug body 210 within the chamber 236.

As a socket receiving end 295 of the plug 201 (enlarged end 216 of the plug body 210) is moved toward the end wall 265 of the socket 202, the conductive spike 280 penetrates the wire 206 and the groove 290 in the flange 242 and tabs 292 extending from the socket main wall 251 engage and lock together. The second sealing member 233 seats within the cavity 270. In this way, the plug body 210 and electrical connection are rendered fluid-tight.

It is to be appreciated that the plug 201 can be used with the socket types as illustrated in the earlier figures.

Further advantages of the present invention as exemplified in FIGS. 67-88 include:

1. The connection can be waterproof, so no exposure of the wire to the atmosphere.

2. No trimming of the wire is necessary because the conductive penetrator can penetrate the sheath as well.

3. The connection can be safely, efficiently and easily made, using only a pair of pliers (at most).

4. The connection apparatus can be used to isolate a live wire.

5. The electrical connection can be wire-to-wire or wire to electrical contact.

6. The wire-receiving passage of the wire-receiving portion can be used to check wire diameter.

7. The connection apparatus can be readily disassembled and reused.

8. The connection apparatus requires no chemical sealant for waterproofing.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A plug adapted to hold a wire and to be received within a socket, said plug comprising a plug body and a passage extending axially within the plug body for receiving the wire, wherein:

the passage extends along a central longitudinal axis of the plug body completely through the plug body including substantially centrally through an end wall of the plug body;

the plug body comprises an inside face and an outside face;

the plug further comprises gripping formations extending inwardly from the inside face for gripping opposing sides of the wire when located within the passage, wherein each said gripping formation comprises one or more gripping teeth that: grip or bite into an exterior insulating coat or sheath of the wire; extend along the inside face of the plug body; and are pointed in a direction that prevents or minimises the risk of the wire being pulled out of the passage in an axial direction; and the plug body is configurable in a first wire-receiving configuration so that the wire can be placed within the passage and a second clamping configuration so that the plug body can clamp to and retain the wire within the passage such that conducting strands of the wire extend along the central longitudinal axis of the plug body, wherein the plug body comprises two plug body portions that are hinged together at said end wall of the plug body and are moveable together into the second clamping configuration, and wherein the two plug body portions resemble a sleeve or tube split into longitudinal halves and are hinged at an end of the sleeve or tube.

2. The plug of claim 1, wherein the plug is of unitary construction.

3. The plug of claim 1, wherein the two plug body portions are substantially identical to each other.

4. The plug of claim 1, wherein:

a first plug body portion of the two plug body portions has a first inside face and a second plug body portion of the two plug body portions has a second inside face, and the first inside face is substantially identical to the second inside face.

5. The plug of claim 1, wherein:

a first plug body portion of the two plug body portions has a first gripping formation and a second plug body portion of the two plug body portions has a second gripping formation, and the first gripping formation is substantially identical to the second gripping formation.

6. The plug of claim 1, wherein when in the second clamping configuration, the inside face has a cross-section shaped to snugly receive the wire having a circular cross-section.

7. The plug of claim 1, wherein being hinged together at said end wall of the plug body enables both said plug body portions to move towards the central longitudinal axis of the plug body so that the plug body can clamp to and retain the wire within the passage.

8. The plug of claim 1, wherein being hinged together at said end wall of the plug body enables both of the plug body portions to move towards or away from the central longitudinal axis of the plug body when configuring the plug body.

9. A connection apparatus comprising the plug of claim 1 and a socket for receiving the plug.

10. The connection apparatus of claim 9, wherein the socket is an opening in an electrical appliance, equipment or device.

11. The connection apparatus of claim 9, wherein the socket comprises an opening extending axially within a main body for receiving the plug.

12. The connection apparatus of claim 11, wherein the main body comprises an outer face, an inner face that extends around the opening and an end wall that borders a blind end of the opening, and wherein the socket comprises an electrical conductor located adjacent the end wall of the socket at the blind end of the opening, for contacting the wire located within the plug.

13. The connection apparatus of claim 12, wherein the socket is in the form of a dual socket for connecting two wires together, said dual socket comprising essentially two said sockets connected at their said end walls, and the conductor of both sockets is connected together.

14. The connection apparatus of claim 12, wherein the conductor is in the form of a penetrator for penetrating the wire when the wire of the plug is inserted into the opening in the socket.

15. The connection apparatus of claim 14, wherein the conductor extends through the end wall of the socket to an exterior of the socket end wall to provide another electrical point of contact.

16. The connection apparatus of claim 15, wherein the socket of the connection apparatus functions as an electrical plug that can be plugged into an electrical appliance, equipment or device.

* * * * *